US011937695B2

(12) United States Patent
Choi

(10) Patent No.: US 11,937,695 B2
(45) Date of Patent: Mar. 26, 2024

(54) HEIGHT-ADJUSTABLE FOLDING TABLE

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/820,515

(22) Filed: Aug. 17, 2022

(65) Prior Publication Data

US 2023/0133183 A1 May 4, 2023

(30) Foreign Application Priority Data

Nov. 1, 2021 (CN) ..... 202122651186.5
Nov. 1, 2021 (CN) ..... 202122651506.7

(51) Int. Cl.
*A47B 9/16* (2006.01)
*A47B 3/08* (2006.01)

(52) U.S. Cl.
CPC . *A47B 9/16* (2013.01); *A47B 3/08* (2013.01)

(58) Field of Classification Search
CPC ..... A47B 3/02; A47B 9/16; A47B 2003/045
USPC ..... 108/118, 117, 116
See application file for complete search history.

(56) References Cited

U.S. PATENT DOCUMENTS 289,561 A * 12/1883 Richmind ..... A47B 9/16 108/116
654,760 A * 7/1900 Pace ..... A47B 9/16 108/116
867,816 A * 10/1907 Garret ..... A47F 5/10 108/157.12
893,364 A 7/1908 Piaser
933,568 A * 9/1909 Krings ..... A47B 3/00 108/121
1,063,642 A 6/1913 Birdsell
1,196,253 A 8/1916 Lovvy
1,368,488 A * 2/1921 Crandall ..... D06F 81/02 108/118
1,582,756 A * 4/1926 Jennings ..... A47B 3/02 108/31

(Continued)

FOREIGN PATENT DOCUMENTS

CA 2971886 12/2018
CN 201767333 U 3/2011

(Continued)

*Primary Examiner* — Jose V Chen
(74) *Attorney, Agent, or Firm* — MORGAN, LEWIS & BOCKIUS LLP

(57) ABSTRACT

A table includes a tabletop and a leg assembly to support the tabletop. The leg assembly comprises first and second supports movably connected to the tabletop. The first support includes a first bar and the second support includes a second bar. The first and second bars are pivotally connected to the first bar. The leg assembly also includes a mechanism for adjusting a height of the leg assembly. The mechanism includes a first coupling piece disposed at the first bar and a second coupling piece pivotally connected to the second bar. One of the first and second coupling pieces includes multiple positioning slots. The other of the first and second coupling pieces is selectively engageable with any one of the positioning slots. Engagement with different positioning slots changes an angle between the first and second bars and consequently changes the height of the leg assembly.

20 Claims, 20 Drawing Sheets

(56) References Cited

U.S. PATENT DOCUMENTS 1,583,695 A * 5/1926 Lane ..... D06F 81/04 108/117
1,599,971 A 9/1926 Melson
2,136,569 A 11/1938 Trimpi
2,572,333 A 10/1951 Meyer
2,624,469 A * 1/1953 Adamson ..... A47B 3/02 108/118
2,641,247 A * 6/1953 Genebach ..... F24C 15/16 126/41 E
2,693,652 A * 11/1954 Kutz ..... D06F 81/04 38/DIG. 3
2,761,743 A * 9/1956 Cottar ..... E04G 1/34 182/186.3
2,803,033 A 8/1957 Rachman
2,803,050 A 8/1957 Birger
2,868,599 A 1/1959 Roggio
2,958,873 A * 11/1960 Ferneau ..... A61G 1/0237 280/43
3,027,209 A 3/1962 Nielsen
3,075,809 A 1/1963 Wilson
3,187,373 A 6/1965 Fisher
3,188,138 A 6/1965 Lockshin
3,368,504 A 2/1968 Cohen
3,410,232 A 11/1968 Bills
3,410,327 A 11/1968 Ausnit
3,750,598 A 8/1973 Campbell
3,861,328 A 1/1975 Lawless
4,191,111 A 3/1980 Emmert
4,244,471 A 1/1981 Plante
4,285,105 A 8/1981 Kirkpatrick
4,561,108 A 12/1985 Kamp
4,597,553 A 7/1986 Rorabaugh
4,763,865 A * 8/1988 Danner ..... G10G 5/00 108/118
4,773,108 A 9/1988 Leever
4,792,240 A 12/1988 Ausnit
5,039,054 A * 8/1991 Pai ..... G10C 3/00 108/146
5,180,064 A 1/1993 Elvin-Jensen
5,226,372 A 7/1993 Frenkel
5,325,794 A 7/1994 Hontani
5,331,725 A 7/1994 Chou
5,483,710 A 1/1996 Chan
5,745,954 A 5/1998 Shogan
5,816,545 A * 10/1998 Malizia ..... F16M 11/38 211/195
5,857,229 A 1/1999 Magnani, Jr.
6,062,589 A 5/2000 Cheng
6,223,366 B1 5/2001 Cheng
6,223,628 B1 5/2001 Barron
6,231,015 B1 * 5/2001 Kun ..... A47C 13/00 108/118
6,354,230 B1 3/2002 Maschio
6,363,550 B1 4/2002 Wang
6,386,118 B1 5/2002 Bendit
6,508,262 B1 1/2003 Takayama
6,575,656 B2 6/2003 Suh
6,843,183 B2 1/2005 Strong
6,923,416 B1 * 8/2005 Hsieh ..... G10H 1/32 248/431
6,938,927 B1 9/2005 Martin
6,971,321 B1 12/2005 Strong
7,059,254 B2 6/2006 Strong et al.
7,066,676 B2 6/2006 Tsai
7,096,799 B2 8/2006 Strong et al.
7,097,380 B2 8/2006 Lee
7,144,078 B2 12/2006 Hsieh
7,171,910 B2 2/2007 Neunzert et al.
7,260,871 B2 8/2007 Borchardt
7,428,872 B2 9/2008 Strong et al.
7,475,643 B2 1/2009 Haney et al.
7,475,644 B2 1/2009 Strong et al.
7,634,969 B2 12/2009 Neunzert et al.
7,640,870 B2 1/2010 Strong et al.
7,644,667 B2 1/2010 Strong et al.
7,735,431 B2 6/2010 Neunzert et al.
7,849,867 B2 12/2010 Takayama
7,874,303 B2 1/2011 Xie
7,926,431 B2 4/2011 Morris
8,006,630 B2 8/2011 Strong et al.
8,033,228 B2 10/2011 Haney et al.
8,042,475 B2 10/2011 Larcom et al.
8,113,130 B2 2/2012 Leng
8,156,875 B2 4/2012 Neunzert et al.
8,302,541 B2 11/2012 Haney et al.
8,336,466 B2 12/2012 Mani
8,342,107 B2 1/2013 Mover et al.
8,534,205 B1 9/2013 Johnson et al.
8,578,865 B2 11/2013 Haney et al.
8,622,007 B2 1/2014 Peery et al.
8,707,478 B2 4/2014 Jin
8,746,155 B2 6/2014 Haney et al.
8,757,069 B2 6/2014 Peery et al.
8,806,677 B1 8/2014 Bartelsmeyer
8,856,984 B1 10/2014 Donham
8,888,123 B1 11/2014 Cheng
8,904,943 B2 12/2014 Jin
9,027,952 B2 5/2015 Zhu
9,103,368 B2 8/2015 Mendes
9,107,509 B2 8/2015 Lee
D748,418 S 2/2016 Johnson et al.
9,248,072 B2 2/2016 Wu
9,254,046 B1 2/2016 Arenstein
9,277,808 B2 3/2016 Cai et al.
9,282,812 B2 3/2016 Chang
9,314,386 B1 4/2016 Boyd
D756,694 S 5/2016 Johnson et al.
9,351,563 B2 5/2016 Bennett et al.
9,456,698 B2 10/2016 Oh
9,532,645 B1 1/2017 Lin
9,644,378 B2 * 5/2017 Knox ..... B60N 2/169
9,907,405 B2 3/2018 An
10,021,986 B1 7/2018 Lin
10,123,629 B2 11/2018 Choi
10,125,801 B2 11/2018 Wilson
10,285,506 B2 5/2019 Choi
10,470,561 B2 11/2019 Clegg et al.
10,806,246 B1 10/2020 Chen
11,286,083 B2 3/2022 Lee
2003/0009848 A1 1/2003 Kuo
2003/0089286 A1 5/2003 Wang
2003/0233967 A1 12/2003 Lin
2005/0005826 A1 1/2005 Strong
2005/0011421 A1 * 1/2005 Zhang ..... B25H 1/04 108/118
2005/0011422 A1 1/2005 Wen
2005/0097829 A1 5/2005 Seo
2005/0193927 A1 9/2005 Herring
2005/0241550 A1 11/2005 Neunzert
2005/0274304 A1 12/2005 Strong
2005/0279260 A1 12/2005 Stanford
2006/0062632 A1 3/2006 Jang
2006/0196395 A1 9/2006 Lin
2006/0236902 A1 10/2006 Haney
2007/0012346 A1 1/2007 Choi
2007/0079441 A1 4/2007 Chen
2007/0199483 A1 8/2007 Peery
2008/0078310 A1 4/2008 VanNimwegen
2009/0114129 A1 5/2009 Smith
2009/0133191 A1 5/2009 Harrow
2009/0255564 A1 10/2009 Xie
2010/0043676 A1 2/2010 Apps
2010/0176634 A1 7/2010 Wahl
2010/0192813 A1 8/2010 Fry
2010/0251941 A1 10/2010 Muirhead
2010/0299831 A1 12/2010 Lee
2011/0099712 A1 5/2011 Jin
2012/0107037 A1 5/2012 Huang
2012/0141195 A1 6/2012 Lu
2012/0222216 A1 9/2012 Jin
2013/0000528 A1 1/2013 Jin
2013/0025509 A1 1/2013 Jin
2013/0067659 A1 3/2013 Oh

(56) References Cited

U.S. PATENT DOCUMENTS

| | | | | |
|---|---|---|---|---|
| 2013/0133557 | A1 | 5/2013 | Yoshinaga | |
| 2013/0233210 | A1 | 9/2013 | Jin | |
| 2013/0276228 | A1 | 10/2013 | Hsieh | |
| 2014/0030012 | A1 | 1/2014 | Lee | |
| 2014/0070070 | A1 | 3/2014 | Shi | |
| 2014/0099155 | A1 | 4/2014 | Chen | |
| 2014/0130837 | A1 | 5/2014 | Sy-Facunda | |
| 2015/0130250 | A1 | 5/2015 | Masunaga | |
| 2015/0143630 | A1 | 5/2015 | Harrow | |
| 2015/0320225 | A1 | 11/2015 | Boyd | |
| 2015/0327684 | A1 | 11/2015 | Lee | |
| 2016/0121460 | A1* | 5/2016 | McMillan | A47B 3/02 269/71 |
| 2016/0157620 | A1 | 6/2016 | Oh | |
| 2016/0348395 | A1 | 12/2016 | Jin | |
| 2017/0013955 | A1 | 1/2017 | Lin | |
| 2017/0122353 | A1 | 5/2017 | Halliburton | |
| 2018/0153302 | A1 | 6/2018 | Jiang | |
| 2018/0192768 | A1 | 7/2018 | Choi | |
| 2019/0150608 | A1 | 5/2019 | Johnson et al. | |
| 2019/0200753 | A1 | 7/2019 | Choi | |
| 2019/0283304 | A1 | 9/2019 | Lin | |
| 2019/0284831 | A1 | 9/2019 | Volin | |
| 2019/0292808 | A1 | 9/2019 | Dotterweich | |
| 2020/0029684 | A1 | 1/2020 | Jiang | |
| 2020/0231333 | A1 | 7/2020 | Holm | |
| 2021/0031831 | A1 | 2/2021 | Yoshizaki | |
| 2021/0147111 | A1 | 5/2021 | Lopez Uran | |
| 2021/0354876 | A1 | 11/2021 | Turner | |

FOREIGN PATENT DOCUMENTS

| | | | |
|---|---|---|---|
| CN | 204336376 | U | 5/2015 |
| CN | 204336377 | U | 5/2015 |
| CN | 209185860 | U | 8/2019 |
| CN | 213464190 | U | 6/2021 |
| DE | 29515948 | | 1/1996 |
| EP | 1492432 | B1 | 10/2016 |
| EP | 2701552 | B1 | 7/2018 |
| GB | 810195 | A | 3/1959 |
| WO | WO 2013000149 | A1 | 1/2013 |

* cited by examiner

HEIGHT-ADJUSTABLE FOLDING TABLE

CROSS-REFERENCE TO RELATED APPLICATIONS

The present application claims priority to Chinese Utility Model Applications CN 202122651506.7 filed Nov. 1, 2021, and CN 202122651186.5 filed Nov. 1, 2021. The disclosure of each application is incorporated herein for all purposes by reference in its entirety.

FIELD OF THE INVENTION

The present invention generally relates to tables, and in particular, relates to height-adjustable folding tables.

BACKGROUND

Most existing folding tables are not adjustable in height. Some are adjustable but the structure for adjusting the height is complex and often involves multiple parts. For instance, CN209185890U discloses a folding table with a control switch to adjust its height, the disclosure of which is incorporated herein for all purposes by reference in its entirety. However, the control switch is often not protected or locked. End users may press the switch by accident or children may play with the switch out of curiosity, causing unexpected folding or collapsing of the table. In some cases, this may lead to hands caught by the table or other safety issues.

Given the current state of the art, there remains a need for tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides table leg assemblies and folding tables that are simple, easy-to-use, and height-adjustable.

In various exemplary embodiments, the present disclosure provides a table including a tabletop and a leg assembly to support the tabletop. The leg assembly includes a first support movably connected to the tabletop at a first portion of the tabletop and a second support movably connected to the tabletop at a second portion of the tabletop. The first support includes a first bar, and the second support includes a second bar. The first bar of the first support and the second bar of the second support are pivotally connected to each other at their middle portions. The leg assembly also includes a mechanism for adjusting height of the leg assembly. The mechanism includes a first coupling piece disposed at the first bar of the first support and a second coupling piece pivotally connected to the second bar of the second support. One of the first and second coupling pieces includes a plurality of positioning slots, and the other of the first and second coupling pieces is selectively engageable with any one of the plurality of positioning slots, thereby allowing changing a first angle between the first bar of the first support and the second bar of the second support to change the height of the leg assembly.

In some exemplary embodiments, the first coupling piece is fixedly connected to or integrally formed with the first bar of the first support.

In some exemplary embodiments, the first bar of the first support and the second bar of the second support are connected to each other at a first pivotal point. The first coupling piece of the mechanism is disposed at the first bar of the first support adjacent to or above the first pivotal point, and the second coupling piece of the mechanism is pivotally connected to the second bar of the second support above the first pivotal point.

In some exemplary embodiments, the first support includes a pair of first bars, a first upper crossbar and a first lower crossbar. The first bars are spaced apart from each other in a first direction of the table. Each first bar has an upper end portion connected to the first upper crossbar and a lower end portion connected to the first lower crossbar. Similarly, the second support includes a pair of second bars, a second upper crossbar and a second lower crossbar. The second bars are spaced apart from each other in the first direction of the table. Each second bar has an upper end portion connected to the second upper crossbar and a lower end portion connected to the second lower crossbar.

In an exemplary embodiment, the tabletop includes first, second, third and fourth engagement slots. The first and second engagement slots are disposed in the first portion of the tabletop, and spaced apart in the first direction of the table with openings of the first and second engagement slots facing each other. The third and fourth engagement slots are disposed in the second portion of the tabletop, and spaced apart in the first direction of the table with openings of the third and fourth engagement slots facing each other. The first upper crossbar of the first support has a first end received in the first engagement slot and a second end received in the second engagement slot such that the first upper crossbar is slidable along the first and second engagement slots in a second direction of the table. The second upper crossbar of the second support has a first end received in the third engagement slot and a second end received in the fourth engagement slot such that the second upper crossbar is slidable along the third and fourth engagement slots in the second direction of the table.

In some exemplary embodiments, the second coupling piece is connected to the second bar of the second support at a second pivotal point. The mechanism further includes a torsion spring disposed at the second pivotal point between the second coupling piece and the second bar of the second support. The torsion spring is connected to the second coupling piece and the second bar of the second support, and configured to prevent accidental disengagement of the first and second coupling pieces.

In an exemplary embodiment, the leg assembly further includes a third bar to help support the tabletop. The third bar is pivotally connected to the tabletop and pivotally connected to the first bar of the first support or the second bar of the second support.

In some exemplary embodiments, the second coupling piece includes a channel generally elongated in a length direction of the second coupling piece and a plurality of positioning slots formed at a side of the channel. The first coupling piece is received, cross-sectional-wise, in the channel of the second coupling piece. The first coupling piece is movable along the channel and selectively engageable with any one of the plurality of positioning slots, thereby allowing the leg assembly to be selectively positioned at any one of a plurality of heights.

In an exemplary embodiment, the first coupling piece is a pin or a post.

In some exemplary embodiments, the channel of the second coupling piece includes a first portion and a second portion at a second angle with respect to the first portion.

In some exemplary embodiments, two or more positioning slots in the plurality of positioning slots are formed along the first portion of the channel.

In an exemplary embodiment, a positioning slot in the plurality of positioning slots is formed at an end of the second portion of the channel. When the first coupling piece engages with the positioning slot formed at the end of the second portion of the channel, the first angle is substantially 180 degrees.

In some exemplary embodiments, the plurality of positioning slots is formed on an edge of the first coupling piece. The second coupling piece includes an end portion releasably engageable with any one of the plurality of positioning slots.

In an exemplary embodiment, the end portion of the second coupling piece is a hook, a clamp, or a hook toggle clamp.

In some exemplary embodiments, when engaging with a respective positioning slot in the plurality of positioning slots, the end portion of the second coupling piece abuts a corresponding tooth formed on the edge of the first coupling piece adjacent to the respective positioning slot.

In an exemplary embodiment, the second coupling piece includes an opening adjacent to the end portion of the second coupling piece. The opening allows a portion of the first coupling piece to pass through when the end portion of the second coupling piece is engaged with a positioning slot in the plurality of positioning slots.

In various exemplary embodiments, the present disclosure provides a table including a tabletop and a leg assembly to support the tabletop. The tabletop includes first, second, third and fourth engagement slots. The first and second engagement slots are disposed in a first portion of the tabletop and spaced apart in a first direction of the table with openings of the first and second engagement slots facing each other. The third and fourth engagement slots are disposed in a second portion of the tabletop and spaced apart in the first direction of the table with openings of the third and fourth engagement slots facing each other. The leg assembly includes a first support, a second support and a mechanism for adjusting a height of the leg assembly. The first support includes a first upper crossbar. The first upper crossbar has a first end received in the first engagement slot and a second end received in the second engagement slot such that the first upper crossbar is slidable along the first and second engagement slots in a second direction of the table. The second support includes a second upper crossbar. The second upper crossbar has a first end received in the third engagement slot and a second end received in the fourth engagement slot such that the second upper crossbar is slidable along the third and fourth engagement slots in the second direction of the table. The mechanism includes a first coupling piece fixedly connected to or integrally formed with the first support and a second coupling piece pivotally connected to the second support. The second coupling piece includes a channel generally elongated in a length direction of the second coupling piece and a plurality of positioning slots formed at a side of the channel. The first coupling piece is received, cross-sectional-wise, in the channel of the second coupling piece. The first coupling piece is movable along the channel and selectively engageable with any one of the plurality of positioning slots, thereby allowing the leg assembly to be selectively positioned at any one of a plurality of heights.

In some exemplary embodiments, the channel of the second coupling piece includes a first portion and a second portion at an obtuse angle with respect to the first portion. Two or more positioning slots in the plurality of positioning slots are formed along the first portion of the channel, and at least one positioning slot in the plurality of positioning slots is formed at an end of the second portion of the channel.

In various exemplary embodiments, the present disclosure provides a table including a tabletop and a leg assembly to support the tabletop. The tabletop includes first, second, third and fourth engagement slots. The first and second engagement slots are disposed in a first portion of the tabletop and spaced apart in a first direction of the table with openings of the first and second engagement slots facing each other. The third and fourth engagement slots are disposed in a second portion of the tabletop and spaced apart in the first direction of the table with openings of the third and fourth engagement slots facing each other. The leg assembly includes a first support, a second support and a mechanism for adjusting a height of the leg assembly. The first support includes a first upper crossbar. The first upper crossbar has a first end received in the first engagement slot and a second end received in the second engagement slot such that the first upper crossbar is slidable along the first and second engagement slots in a second direction of the table. The second support includes a second upper crossbar. The second upper crossbar has a first end received in the third engagement slot and a second end received in the fourth engagement slot such that the second upper crossbar is slidable along the third and fourth engagement slots in the second direction of the table. The mechanism includes a first coupling piece fixedly connected to or integrally formed with the first support and a second coupling piece pivotally connected to the second support. The first coupling piece includes a plurality of positioning slots formed on an edge of the first coupling piece. The second coupling piece includes an end portion releasably and selectively engageable with any one of the plurality of positioning slots, thereby allowing the leg assembly to be selectively positioned at any one of a plurality of heights.

In some exemplary embodiments, the end portion of the second coupling piece is a hook, a clamp, or a hook toggle clamp. The second coupling piece includes an opening adjacent to the end portion of the second coupling piece. The opening allows a portion of the first coupling piece to pass through when the end portion of the second coupling piece is engaged with a positioning slot in the plurality of positioning slots.

The tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
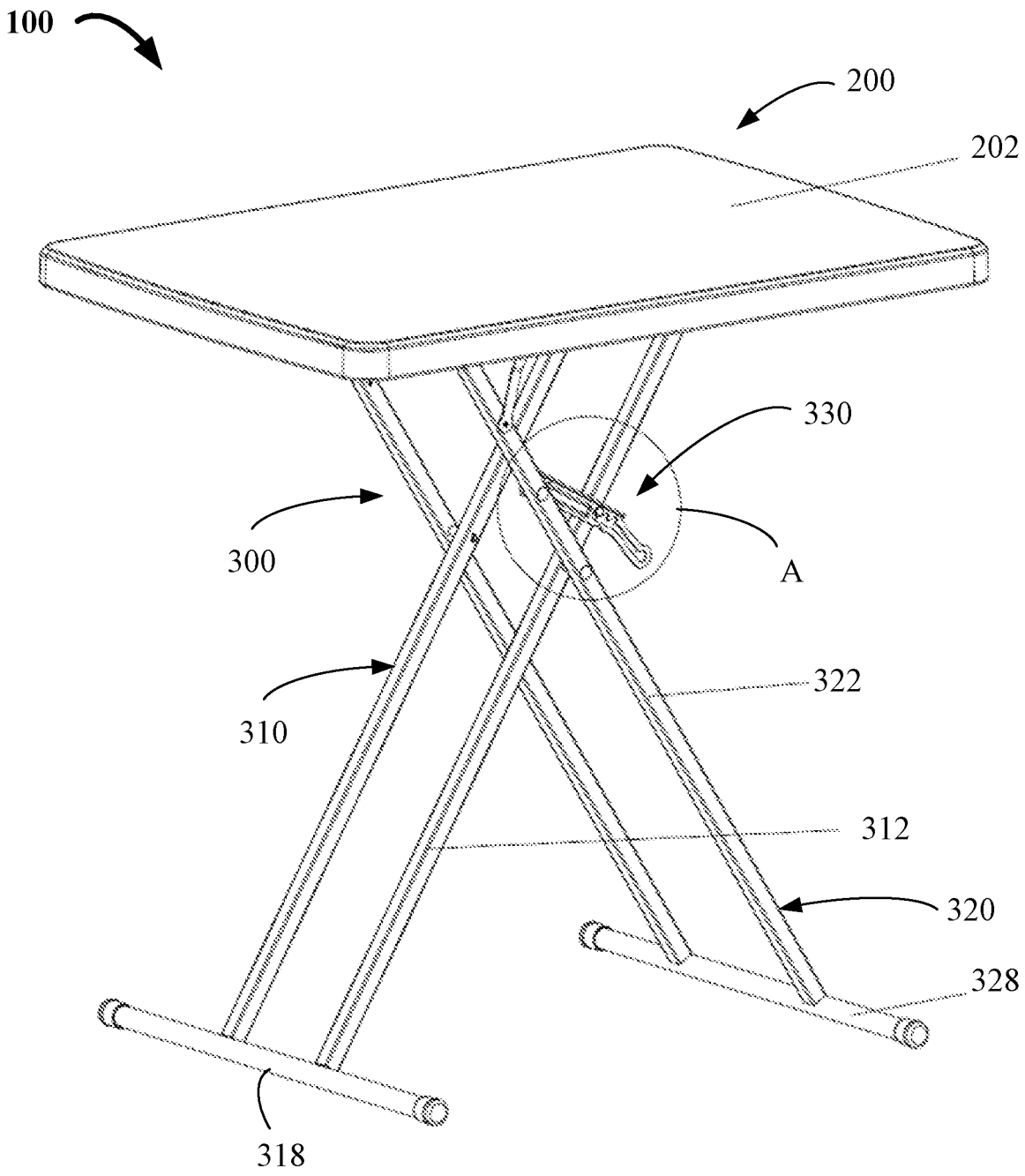
FIG. 1A is a top perspective view illustrating an exemplary table in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of leg assemblies and tables having such leg assemblies. A leg assembly of the present disclosure generally includes a first support and a second support that collectively form one or more scissor lifts each having one or more pairs of crisscrossed bars. A leg assembly of the present disclosure also includes a mechanism connected to the first and second supports and configured to control the expansion and contraction of the one or more scissor lifts, and thus changes the height of the leg assembly. For instance, in various exemplary embodiments, a mechanism includes a first coupling piece and a second coupling piece. The first coupling piece is disposed at one of the first and second supports, and the second coupling piece is disposed at the other of the first and second supports. In some exemplary embodiments, the first coupling piece is fixedly connected to or integrally formed with one of the first and second supports, and the second coupling is pivotally connected to the other of the first and second supports. In some exemplary embodiments, one of the first and second coupling pieces includes a plurality of positioning slots, and the other of the first and second coupling pieces is selectively engageable with any one of the plurality of positioning slots, thereby allowing changing an angle between the first support and the second support and consequently changing the height of the leg assembly and the height of the table. The leg assembly of the present disclosure can be made of various materials including but not limited to metals (e.g., iron, steel, and aluminum), plastics and woods.

A table of the present disclosure generally includes a tabletop and a leg assembly to support the tabletop. It can be of various sizes. For instance, a table of the present disclosure can be a coffee table, a dining table, a picnic table or the like. The tabletop can be of various shapes including but not limited to a square shape, a round shape or a rectangular shape, and can be made of various materials including, but not limited to, plastics and woods. In some exemplary embodiments, the tabletop includes a table panel made of plastics by injection molding, blow molding or any other suitable processes.

Referring now to FIGS. 1A-7, there is depicted an exemplary table 100 in accordance with some embodiments of the present disclosure. As shown, table 100 includes a tabletop, such as tabletop 200. While tabletop 200 is of a rectangular shape in the figures, it should be noted that tabletop 200 can be of any suitable shapes including but not limited to rectangular, square, round, oval, oblong or the like.

In various exemplary embodiments, tabletop 200 includes an upper surface such as upper surface 202, a lower surface such as lower surface 204, and an edge such as edge 206. In some exemplary embodiments, the edge is extended downward beyond the lower surface of the tabletop.

Figure 2:
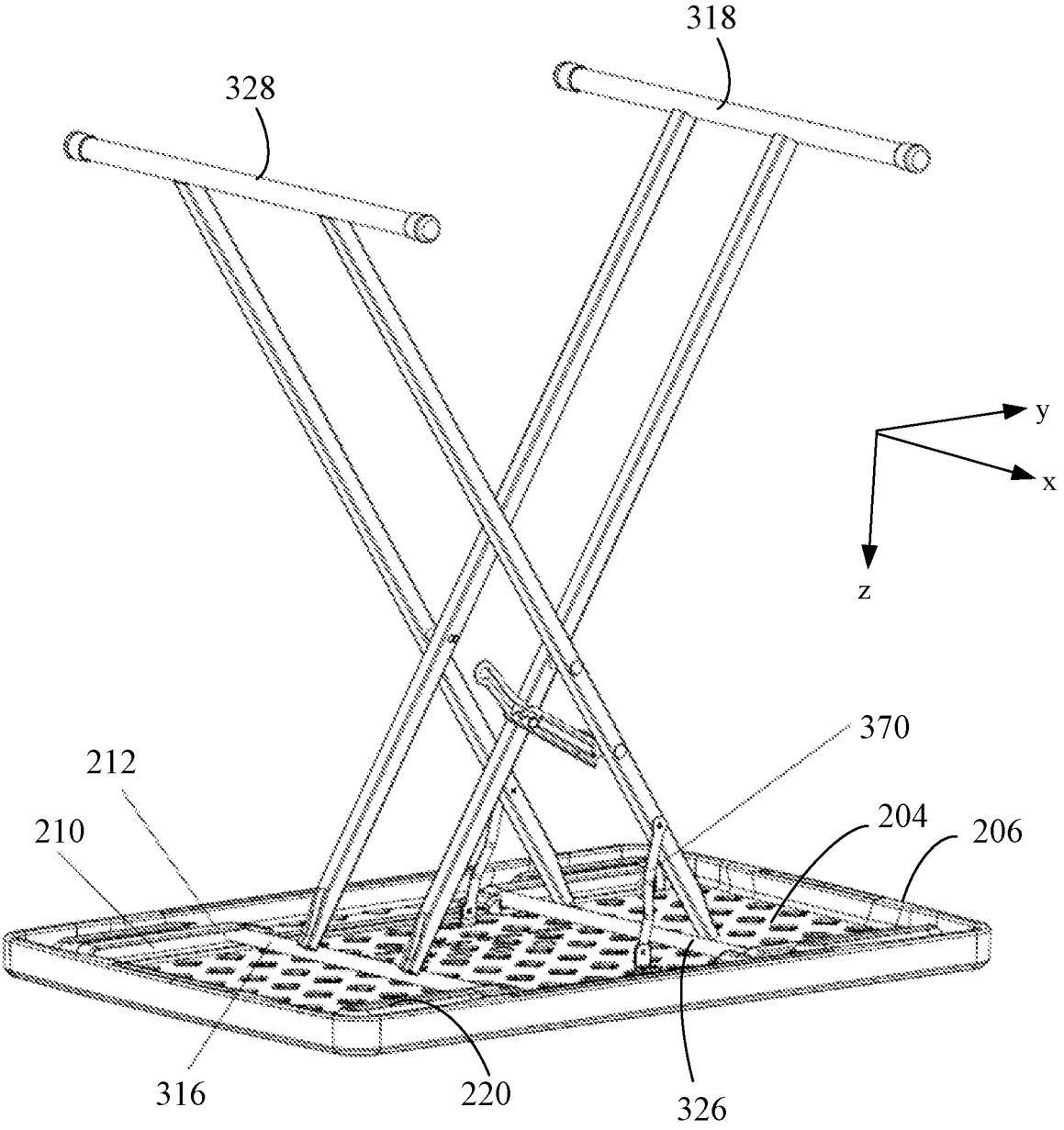
FIG. 2 is a bottom perspective view illustrating the exemplary table of FIG. 1A at a first height in accordance with exemplary embodiments of the present disclosure.
Figure 5:
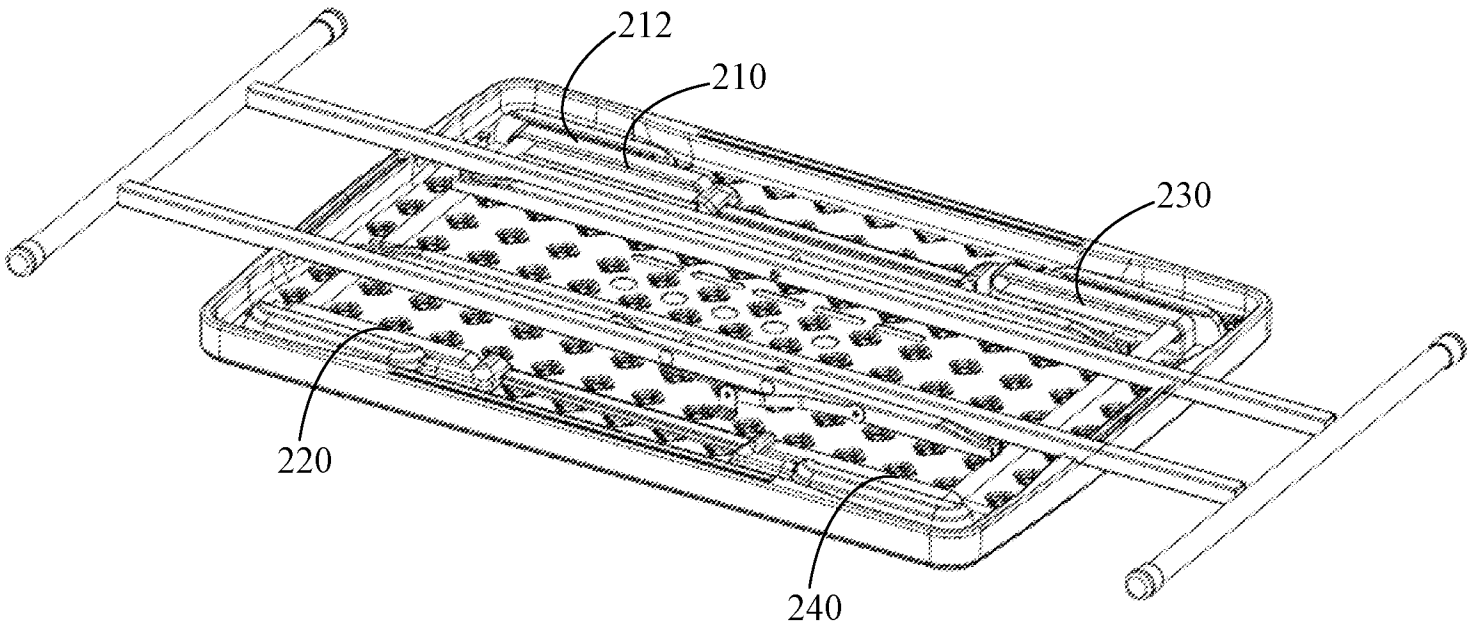
FIG. 5 is a bottom perspective view illustrating the exemplary table of FIG. 1A in a folded state in accordance with exemplary embodiments of the present disclosure.

In some exemplary embodiments, tabletop 200 also includes a plurality of engagement slots for coupling with the leg assembly. For instance, by way of example, FIGS. 2 and 5 illustrate first engagement slot 210, second engagement slot 220, third engagement slot 230 and fourth engagement slot 240. The first and second engagement slots are spaced apart in a first direction (e.g., x-direction in FIG. 2) of the table with openings of the first and second engagement slots facing each other. The third and fourth engagement slots are spaced apart in the first direction of the table with openings of the third and fourth engagement slots facing each other. It should be noted that the first and third engagement slots can be but are not necessarily aligned in a second direction (e.g., y-direction in FIG. 2), and similarly the second and fourth engagement slots can be but are not necessarily aligned in the second direction. By way of example, FIG. 2 illustrates the first and third engagement slots aligned in the second direction, and the second and fourth engagement slots aligned in the second direction.

In some exemplary embodiments, an engagement slot (e.g., the first, second, third or fourth engagement slot) is formed at least partially in a protrusion. For instance, first engagement slot 210 is formed at least partially in a protrusion, such as protrusion 212. In some exemplary embodiments, the protrusion is integrally formed or coupled with the lower surface of the tabletop. For instance, in an exemplary embodiment, the upper surface, the lower surface, the edge, and the protrusion are elements of a table panel formed by injection or blow molding of plastics, with the protrusion protruding downward from the lower surface of the tabletop. While FIGS. 2 and 5 illustrate the protrusion at, or adjacent to, the edge of the tabletop, it should be noted that the protrusion does not necessarily need to be disposed at, or adjacent to, the edge of the tabletop. The protrusion for the second, third or fourth engagement slot can be configured similarly to the first engagement slot or differently from the first engagement slot.

Table 100 also includes a leg assembly, such as leg assembly 300. The leg assembly is coupled with the tabletop and supports the tabletop when in use. In various exemplary embodiments, leg assembly 300 includes a first support, such as first support 310, and a second support, such as second support 320. The first support is movably connected to the tabletop at a first portion of the tabletop, and the second support is movably connected to the tabletop at a second portion of the tabletop. Leg assembly 300 also includes a mechanism, such as mechanism 330, connected to the first and second supports for adjusting a height of the leg assembly, and consequently adjusting a height of the table.

In some exemplary embodiments, the first and second supports of the leg assembly collectively form one or more scissor lifts each including one or more pairs of crisscrossed bars. For instance, in an exemplary embodiment, the first and second supports of the leg assembly collectively form a scissor lift including a pair of crisscrossed bars, two pairs of crisscrossed bars, or more than two pairs of crisscrossed bars. In another exemplary embodiment, the first and second supports of the leg assembly collectively form a pair of scissor lifts, each scissor lift including a pair of crisscrossed bars, two pairs of crisscrossed bars, or more than two pairs of crisscrossed bars. In still another exemplary embodiment, the first and second supports of the leg assembly collectively form more than two scissor lifts.

By way of example, it is illustrated that first support 310 and second support 320 collectively form a scissor lift including two pairs of crisscrossed bars. Specifically, first support 310 includes a pair of first bars, such as first bar 312, spaced apart from each other in the first direction (e.g., x-direction in FIG. 2) of the table. Similarly, second support 320 includes a pair of second bars, such as second bar 322, spaced apart from each other in the first direction of the table. The two first bars can be disposed between the second bars in the first direction of the table (e.g., the distance between the two first bars is smaller than the distance between the two second bars), or outside of the second bars in the first direction of the table (e.g., the distance between the two first bars is greater than the distance between the two second bars), or alternating with the second bars in the first direction of the table (e.g., the distance between the two first bars is substantially the same as the distance between the two second bars). A first bar of the first support and a second bar of the second support are pivotally connected to each other at their middle portions. It should be noted that the pivotal connection point at the middle portions can be but is not necessarily a central point of the bars.

In some exemplary embodiments, first support 310 also includes an upper crossbar, such as upper crossbar 316, to which upper end portions of the first bars of the first support are connected. The upper crossbar of the first support is movably connected to the tabletop. For instance, in an exemplary embodiment, the upper crossbar of the first support has a first end received in the first engagement slot (e.g., inserted into the first engagement slot) and a second end received in the second engagement slot. The first and second engagement slots allow the upper crossbar of the first support to slide along the first and second engagement slots in the second direction (e.g., the y-direction in FIG. 2) of the table. In some exemplary embodiments, the first and second engagement slots also allows the upper crossbar of the first support to rotate with respect to the first and second engagement slots.

Similarly, in some exemplary embodiments, second support 320 includes an upper crossbar such as upper crossbar 326, to which upper end portions of the second bars of the second support are connected. The upper crossbar of the second support is movably connected to the tabletop. For instance, in an exemplary embodiment, the upper crossbar of the second support has a first end received in the third engagement slot and a second end received in the fourth engagement slot. The third and fourth engagement slots allow the upper crossbar of the second support to slide along the third and fourth engagement slots in the second direction of the table. In some exemplary embodiments, third and fourth engagement slots allow the upper crossbar of the second support to rotate with respect to the first and second engagement slots.

In some exemplary embodiments, first support 310 further includes a lower crossbar, such as lower crossbar 318, to which lower end portions of the first bars of the first support are connected. Similarly, in some exemplary embodiments, second support 320 further includes a lower crossbar, such as lower crossbar 328, to which lower end portions of the second bars of the second support are connected.

Figure 1B:
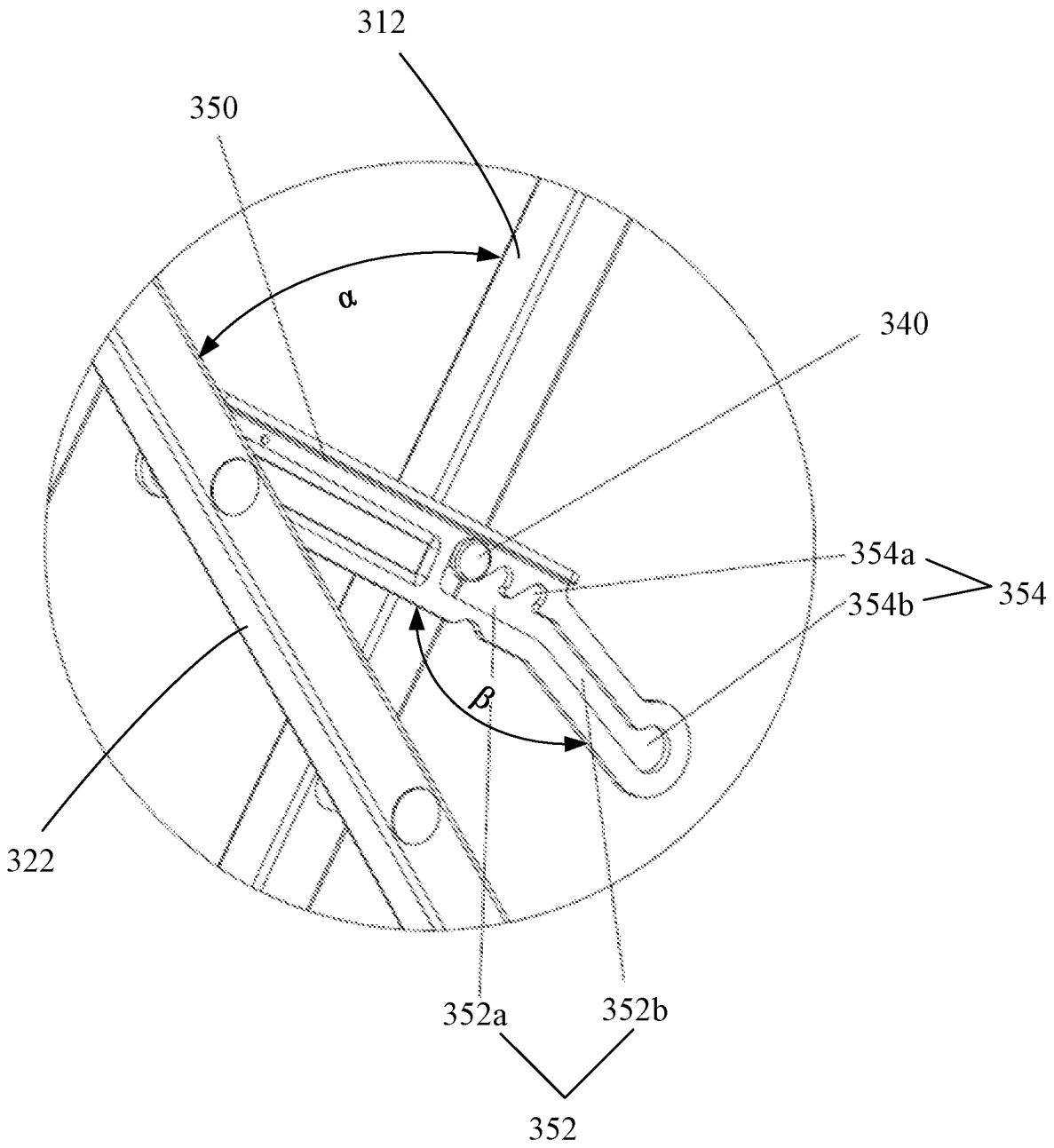
FIG. 1B is an enlarged view taken along circle A of FIG. 1A.
Figure 6A:
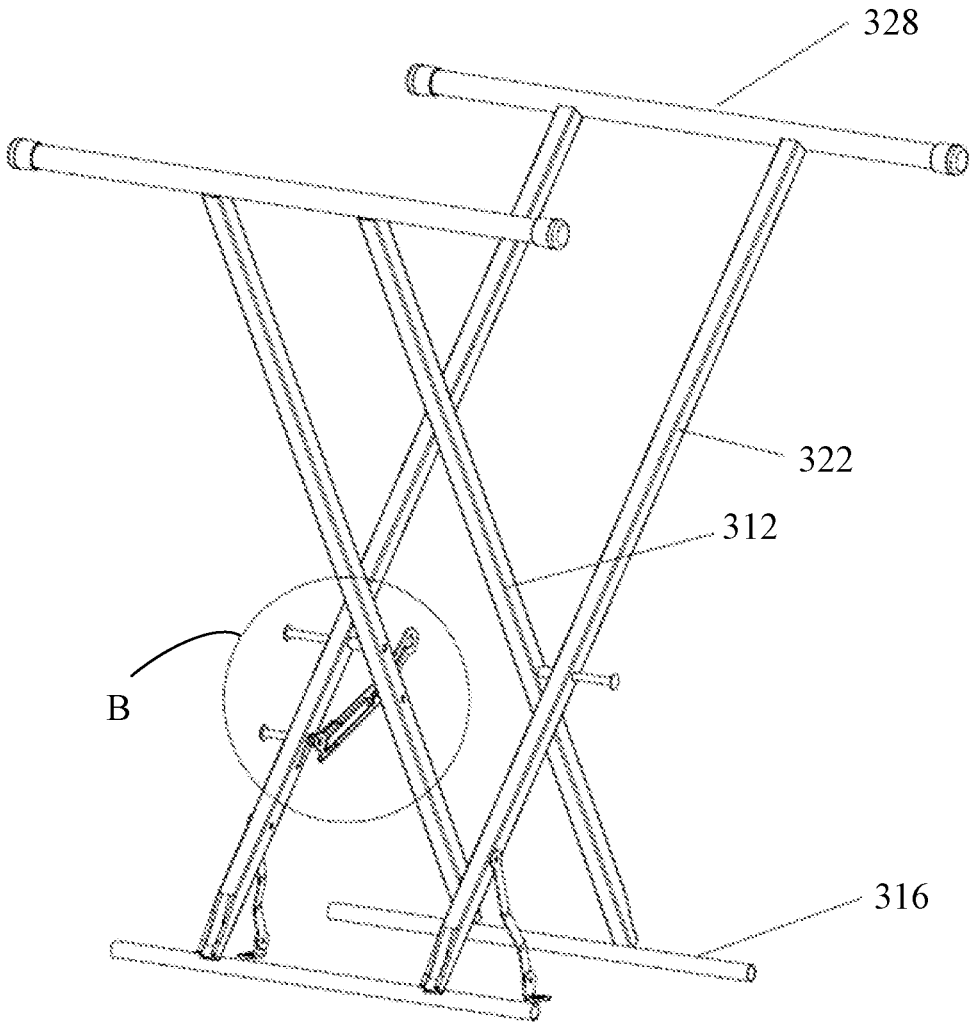
FIG. 6A is a perspective view illustrating an exemplary leg assembly in accordance with exemplary embodiments of the present disclosure.
Figure 6B:
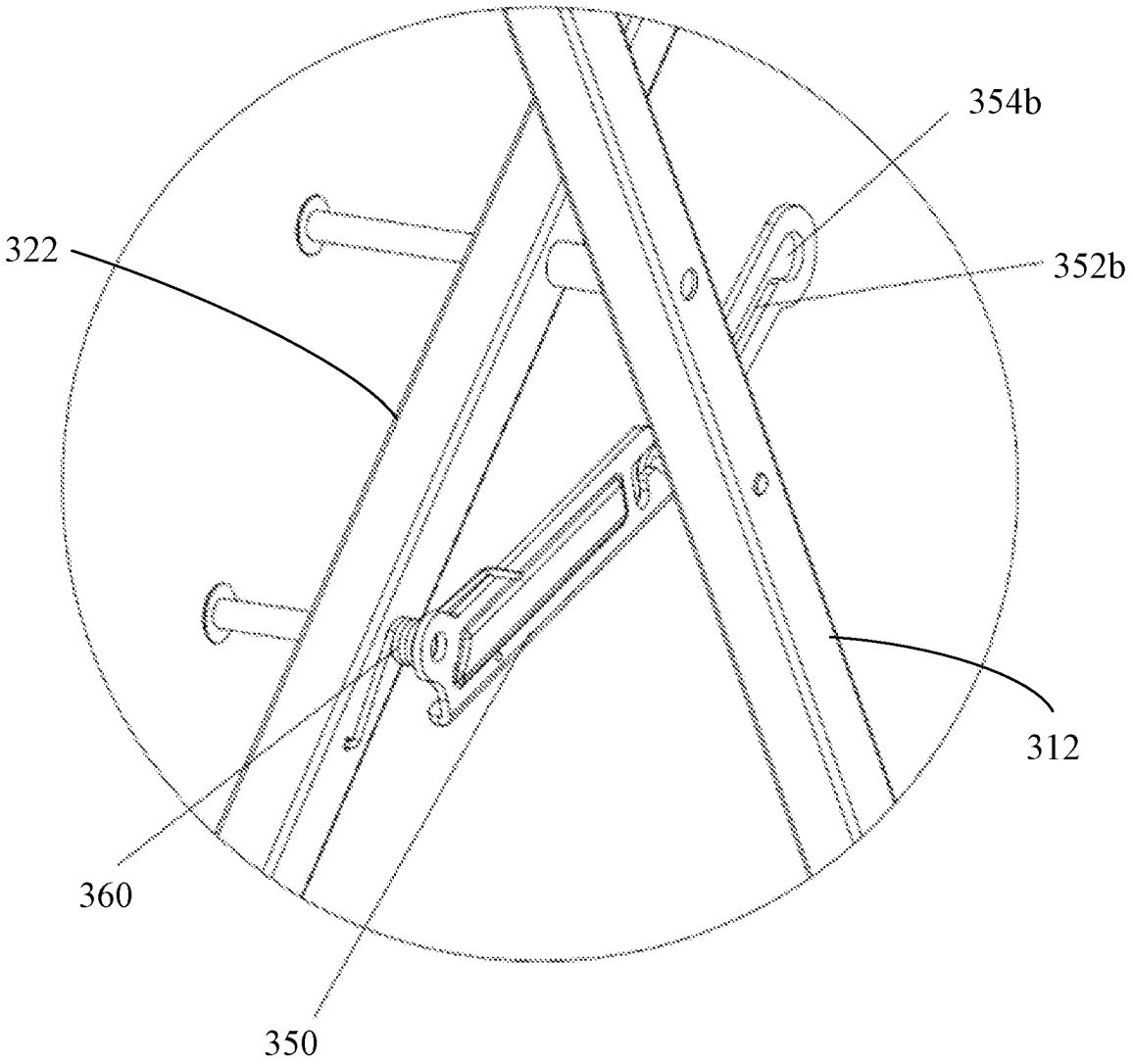
FIG. 6B is an enlarged view taken along circle B of FIG. 6A.
Figure 7:
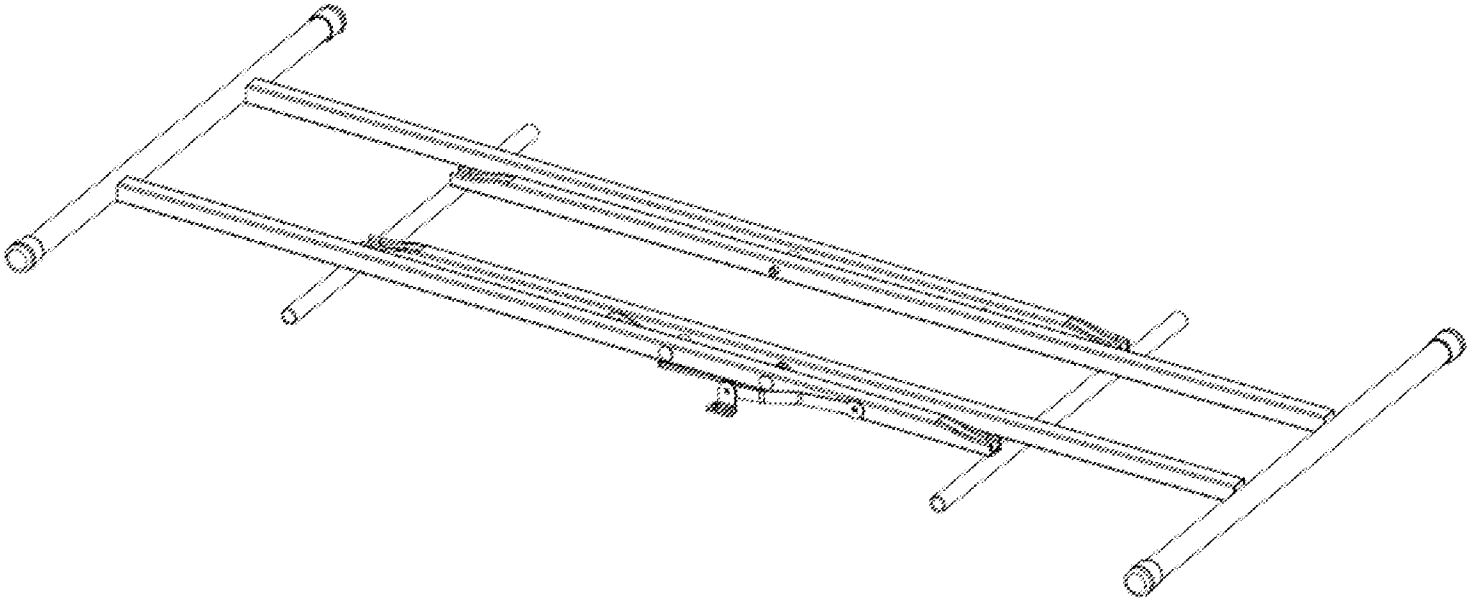
FIG. 7 is a perspective view illustrating the exemplary leg assembly of FIG. 6A in a folded state in accordance with exemplary embodiments of the present disclosure.
Figure 8A:
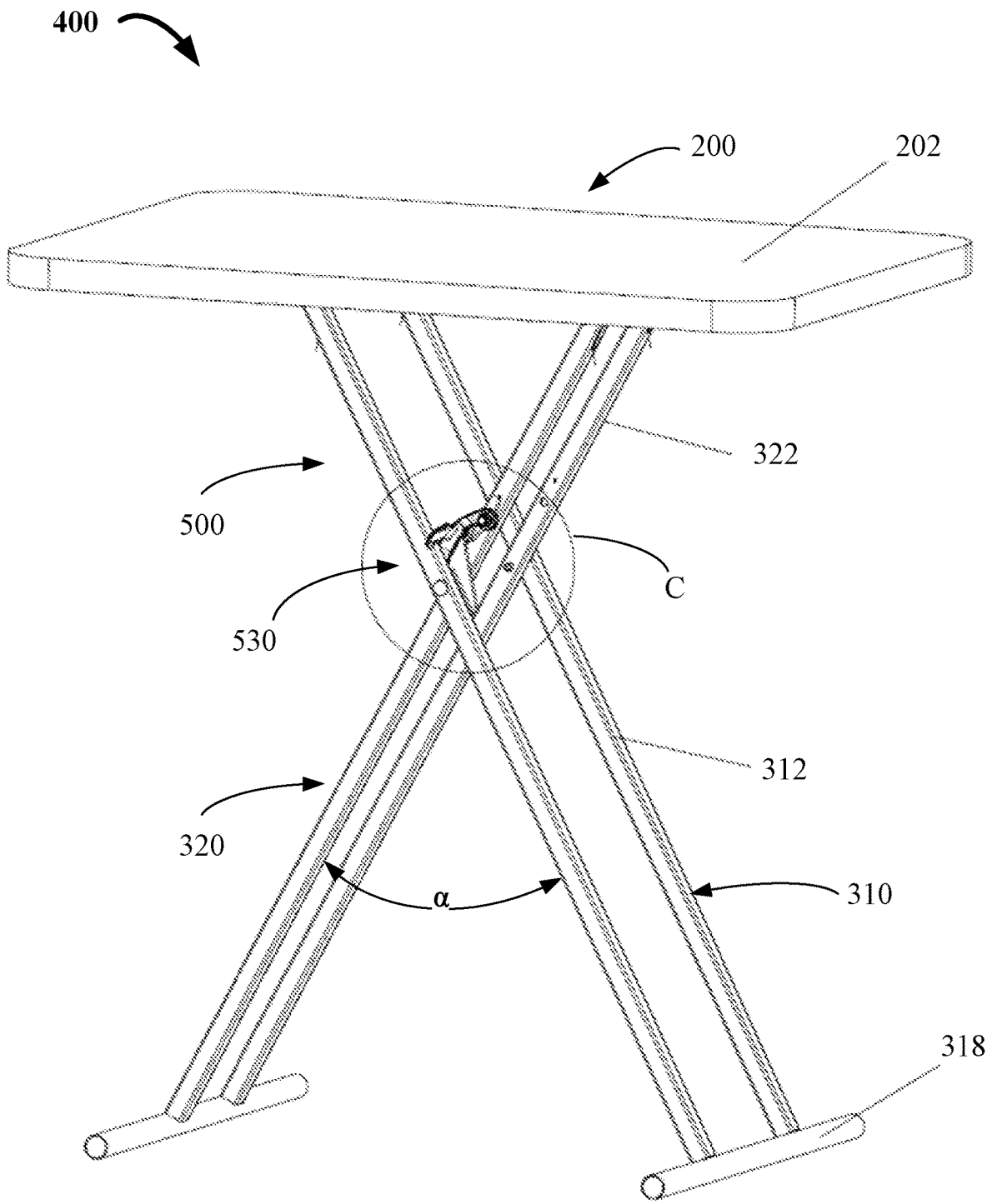
FIG. 8A is a top perspective view illustrating an exemplary table in a locked state in accordance with exemplary embodiments of the present disclosure.
Figure 8B:
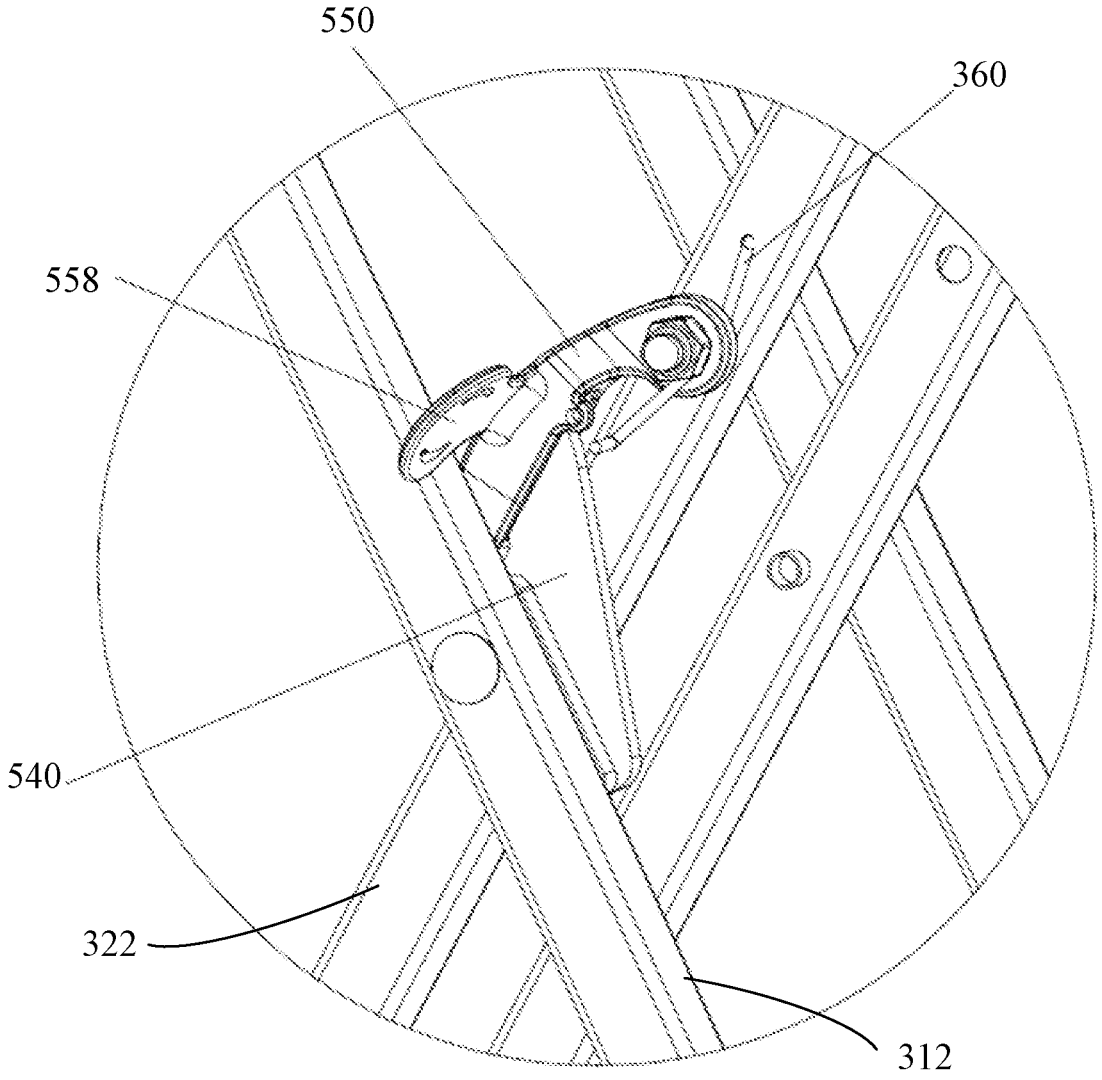
FIG. 8B is an enlarged view taken along circle C of FIG. 8A.
Figure 9A:
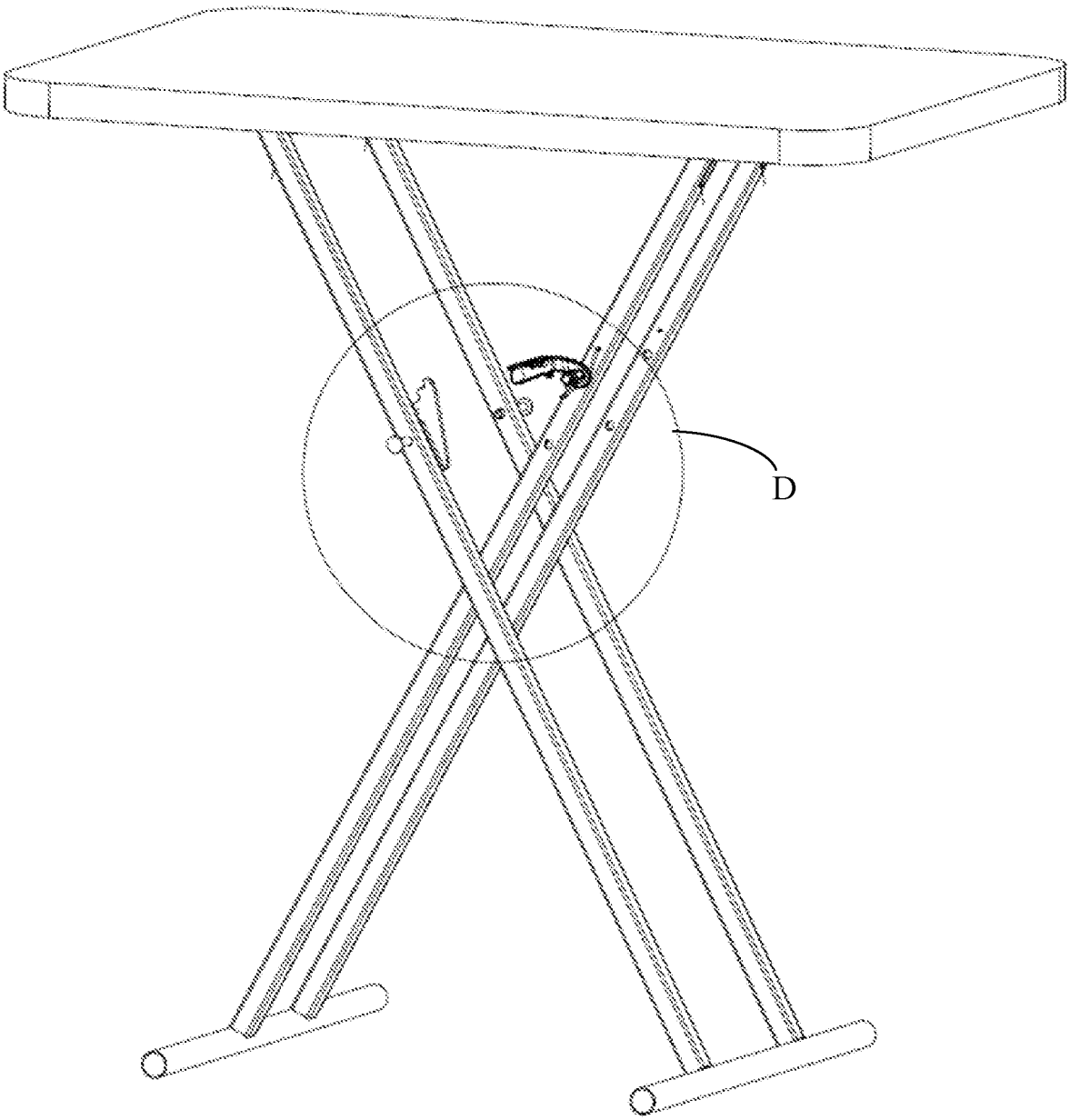
FIG. 9A is a top perspective view illustrating the exemplary table of FIG. 8A in an unlocked state in accordance with exemplary embodiments of the present disclosure.
Figure 9B:
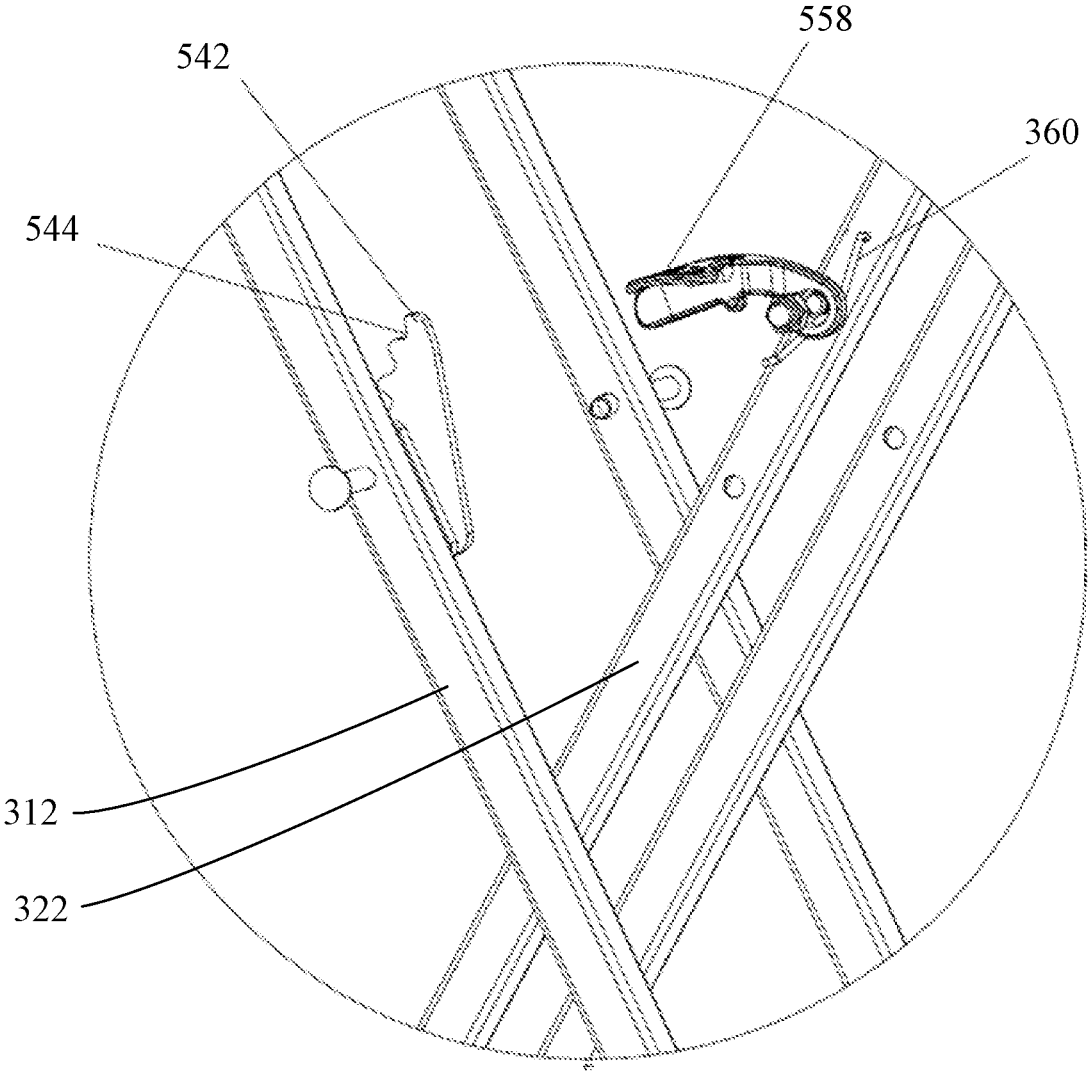
FIG. 9B is an enlarged view taken along circle D of FIG. 9A.

Referring in particular to FIGS. 1B and 6B, in some exemplary embodiments, mechanism 330 includes a first coupling piece, such as first coupling piece 340, and a second coupling piece, such as second coupling piece 350. The first coupling piece is disposed at one of the first and second supports, and the second coupling piece is pivotally connected to the other one of the first and second supports. In some exemplary embodiments, the first coupling piece is fixedly connected to or integrally formed with one of the first and second supports.

As a non-limiting example, it is illustrated that first coupling piece 340 is disposed at (e.g., fixedly connected to or integrally formed with) first bar 312 of the first support and second coupling piece 350 is pivotally connected to second bar 322 of the second support. The first and second coupling pieces of the mechanism can be disposed at the first bar of the first support and the second bar of the second support at any suitable positions, e.g., either adjacent to, above, or below a pivotal point at which the first bar of the first support and the second bar of the second support are connected to each other. In the illustrated embodiment, the first coupling piece and the second coupling piece of the mechanism are disposed respectively at the first bar of the first support and the second bar of the second support above the pivotal point at which the first bar of the first support and the second bar of the second support are connected to each other.

In some exemplary embodiments, one of the first and second coupling pieces includes a plurality of positioning slots, and the other of the first and second coupling pieces is selectively engageable with any one of the plurality of positioning slots, thereby allowing changing an angle between the first bar of the first support and the second bar of the second support and consequently changing the height of the leg assembly and the height of the table.

For instance, in the illustrated embodiment, second coupling piece 350 includes a channel, such as channel 352. The channel is generally elongated in a length direction of the second coupling piece and the plurality of positioning slots is formed at a side of the channel. The channel can be straight, curved or angled. As a non-limiting example, it is illustrated that channel 352 includes two portions, e.g., first portion 352*a* and second portion 352*b*. The first and second portions of the channel are at an angle with respect to each other, generally designated as "β". Usually, the angle β is greater than 90 degrees, or is an obtuse angle.

The second coupling piece also includes a plurality of positioning slots, such as positioning slots 354, formed at a side of the channel. The second coupling piece can have any suitable number of positioning slots, e.g., two, three, four, five, six or more than six positioning slots. Moreover, the positioning slots can be arranged along the length direction of the second coupling piece uniformly or nonuniformly. Further, different positioning slots can have the same configuration (e.g., size, shape) or different configurations. In some exemplary embodiments, two or more positioning slots, such as positioning slot 354*a*, are formed on a side of the first portion of the channel, and/or at least one positioning slot, such as positioning slot 354*b*, is formed on a side of the second portion of the channel.

Cross-sectional-wise, first coupling piece 340 is received in the channel of the second coupling piece. The first coupling piece can move along the channel and selectively engage with any one of the plurality of positioning slots. The engagement of the first coupling piece with a respective positioning slot in the plurality of positioning slots sets the first bar of the first support and the second bar of the second support at a corresponding angle, generally designated as "a". The engagement of the first coupling piece with different positioning slots changes the angle "a" between the first bar of the first support and the second bar of the second support, resulting in the leg assembly (and thus the table) at different heights.

Figure 3:
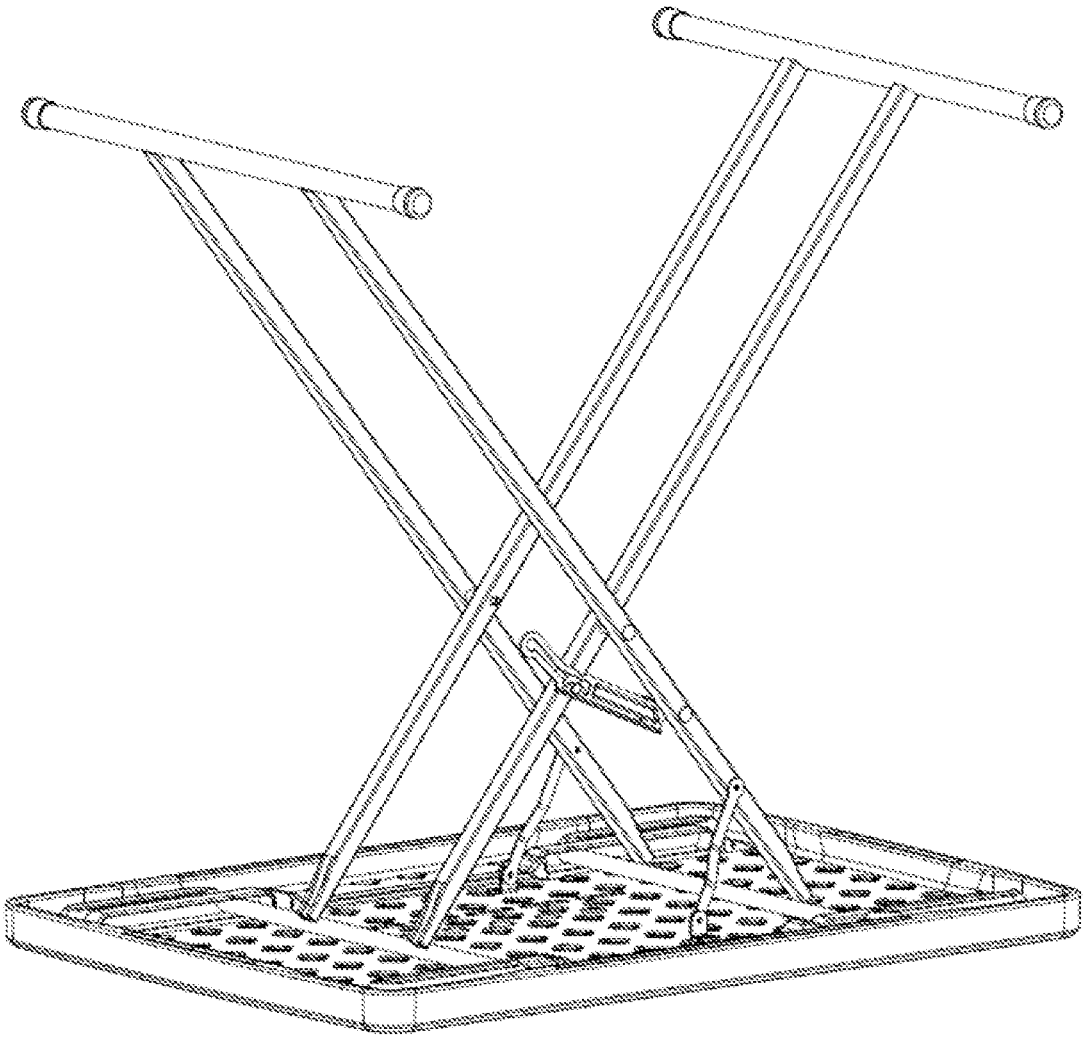
FIG. 3 is a bottom perspective view illustrating the exemplary table of FIG. 1A at a second height in accordance with exemplary embodiments of the present disclosure.
Figure 4:
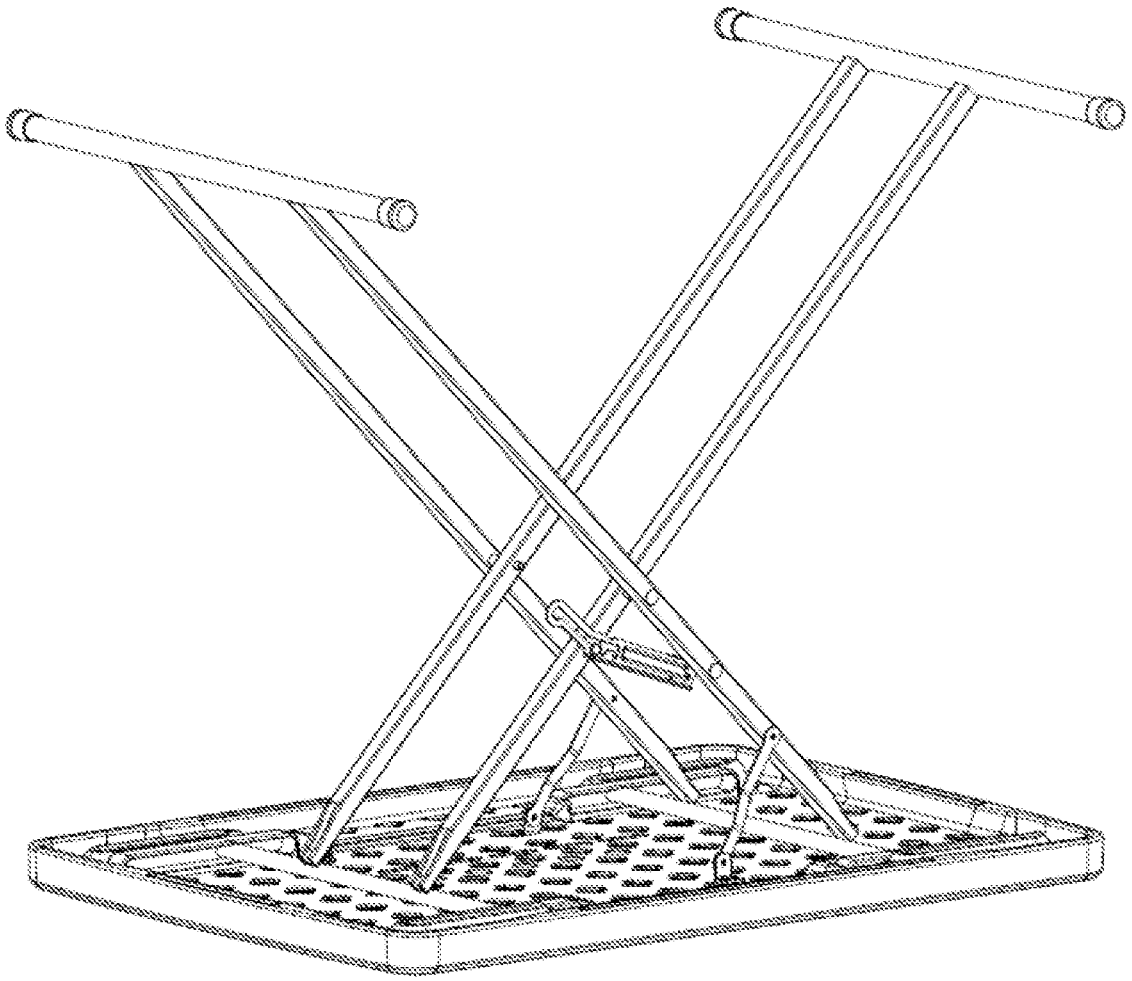
FIG. 4 is a bottom perspective view illustrating the exemplary table of FIG. 1A at a third height in accordance with exemplary embodiments of the present disclosure.

For instance, in the illustrated embodiment, three positioning slots 354*a* are formed on a side of the first portion of the channel, and one positioning slot 354*b* is formed at an end of the second portion of the channel (e.g., the distal end of the second coupling piece that is away from the pivotal connection of the second coupling piece with second bar 322 of the second support). The engagement of the first coupling piece with three positioning slots 354*a* results in the leg assembly (and thus the table) at three different heights as illustrated in FIGS. 2, 3, and 4, respectively. In an exemplary embodiment, the three different heights are about 700 mm, about 650 mm, and about 600 mm, respectively.

In some exemplary embodiments, when the first coupling piece engages with one positioning slot 354*b* formed at the end of the second portion of the channel, the first angle is substantially 180 degrees. In other words, the first bar of the first support and the second bar of the second support are disposed substantially in a common plane, and in some cases, are folded onto the table panel as illustrated in FIG. 5. Folded tables can be stacked together, require less storage space and are convenient for transportation.

Referring in particular to FIG. 6B, in some exemplary embodiments, mechanism 330 includes a torsion spring, such as torsion spring 360, to prevent accidental disengagement of the first and second coupling pieces. The torsion spring is disposed between the second coupling piece and the second bar of the second support at a pivotal point to which the second coupling piece is connected to the second bar of the second support. The torsion spring is connected to the second coupling piece and the second bar of the second support, and exerts a torque on the second coupling piece to prevent accidental separation or disengagement of the first coupling piece from the selected positioning slot formed in the second coupling piece. The torsion spring helps to stabilize the table when in use.

In some exemplary embodiments, to help support the tabletop, the leg assembly further includes one or more additional supports. For instance, in some exemplary embodiments, the leg assembly includes one or more third bars, such as third bar 370, connected to the tabletop, the first support, and/or the second support. In an exemplary embodiment, third bar 370 is pivotally connected to the tabletop and pivotally connected to the first bar of the first support or the second bar of the second support.

Referring now to FIGS. 8A-14B, there is depicted an exemplary table 400 in accordance with some embodiments of the present disclosure. Table 400 is substantially the same as table 100 except the mechanism for adjusting the height of the leg assembly and the height of the table. For instance, as shown, table 400 includes a tabletop, such as tabletop 200 disclosed herein, and a leg assembly, such as leg assembly 500, coupled with the tabletop and supports the tabletop when in use. Leg assembly 500 includes a first support, such as first support 310 disclosed herein, and a second support, such as second support 320 disclosed herein. The first support movably connected to the tabletop at a first portion of the tabletop, and the second support movably connected to the tabletop at a second portion of the tabletop. Leg assembly 500 also includes a mechanism, such as mechanism 530, connected to the first and second supports for adjusting a height of the leg assembly, and consequently adjusting a height of the table.

Referring in particular to FIGS. 8B, 9B, 13B and 14B, in some exemplary embodiments, mechanism 530 includes a first coupling piece, such as first coupling piece 540, and a second coupling piece, such as second coupling piece 550. The first coupling piece is disposed at (e.g., fixedly connected to or integrally formed with) one of the first and second supports, and the second coupling piece is pivotally connected to the other one of the first and second supports. As a non-limiting example, it is illustrated that first coupling piece 540 is disposed at first bar 312 of the first support and second coupling piece 550 is pivotally connected to second bar 322 of the second support. The first and second coupling pieces of the mechanism can be disposed at the first bar of the first support and the second bar of the second support at any suitable positions, e.g., adjacent to, above, or below the pivotal point at which the first bar of the first support and the second bar of the second support are connected to each other. As a non-limiting example, it is illustrated that the first coupling piece of the mechanism is disposed at or adjacent to the pivotal point and the second coupling piece is disposed above the pivotal point.

In some exemplary embodiments, first coupling piece 540 includes a plurality of positioning slots (e.g., two, three, four, five, six or more than six positioning slots), such as slot 544, that is formed on an edge of the first coupling piece. In some exemplary embodiments, the plurality of positioning slots is formed along with a plurality of teeth, such as tooth 542, on the edge of the first coupling piece.

Second coupling piece 550 is configured to releasably engage with any one of the plurality of positioning slots. The second coupling piece is generally perforated or indented. For instance, in some exemplary embodiments, second coupling piece 550 is perforated or indented to form an end portion, such as end portion 552, so that it can be placed (at least partially) in any one of the plurality of positioning slots and abuts the tooth formed on the edge of the first coupling piece adjacent to the positioning slot. The end portion of the second coupling piece can have any suitable configurations, including but not limited to a hook, a clamp, a hook toggle clamp, or the like.

Figure 10:
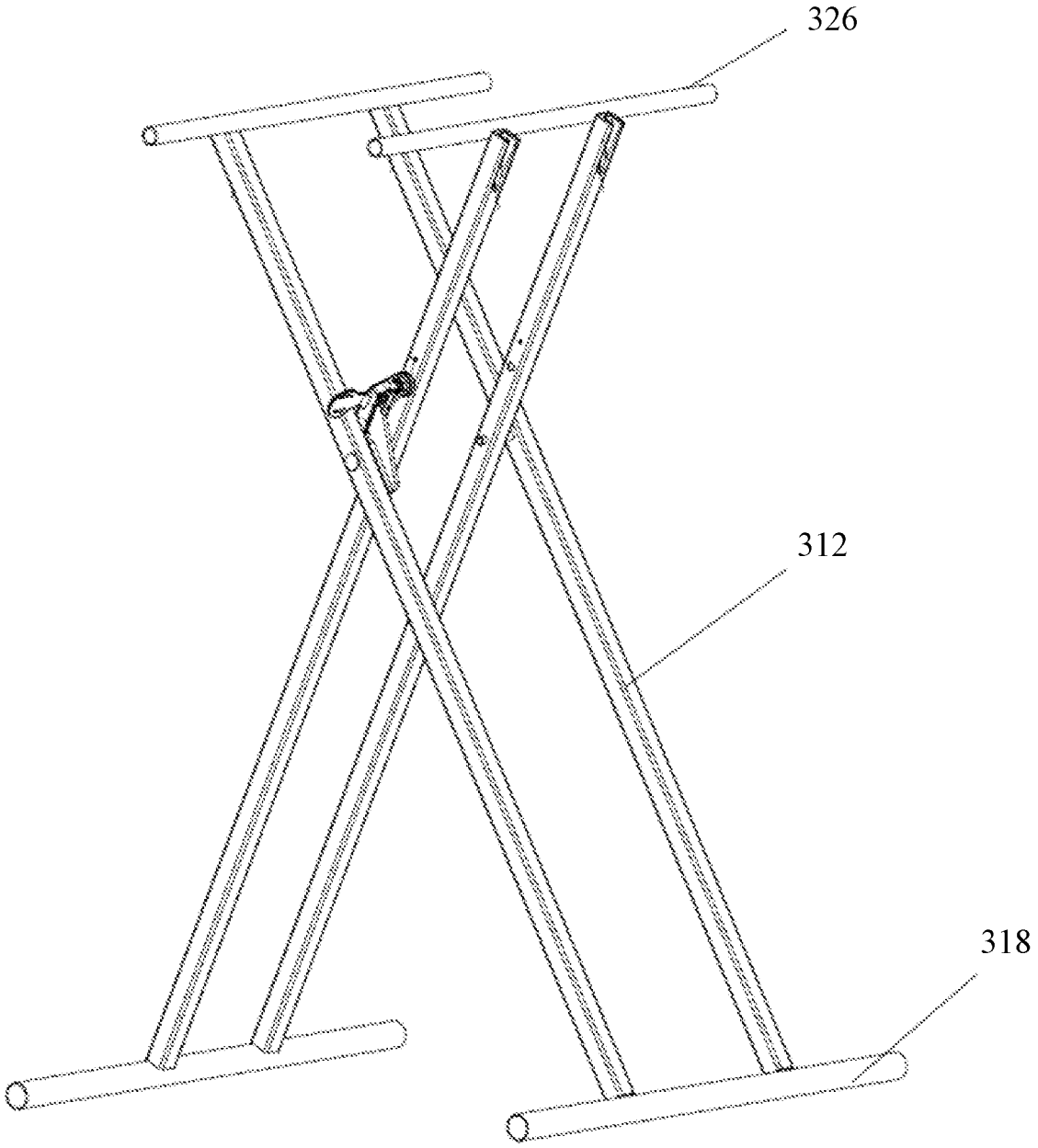
FIG. 10 is a perspective view illustrating an exemplary leg assembly at a first height in accordance with exemplary embodiments of the present disclosure.
Figure 11:
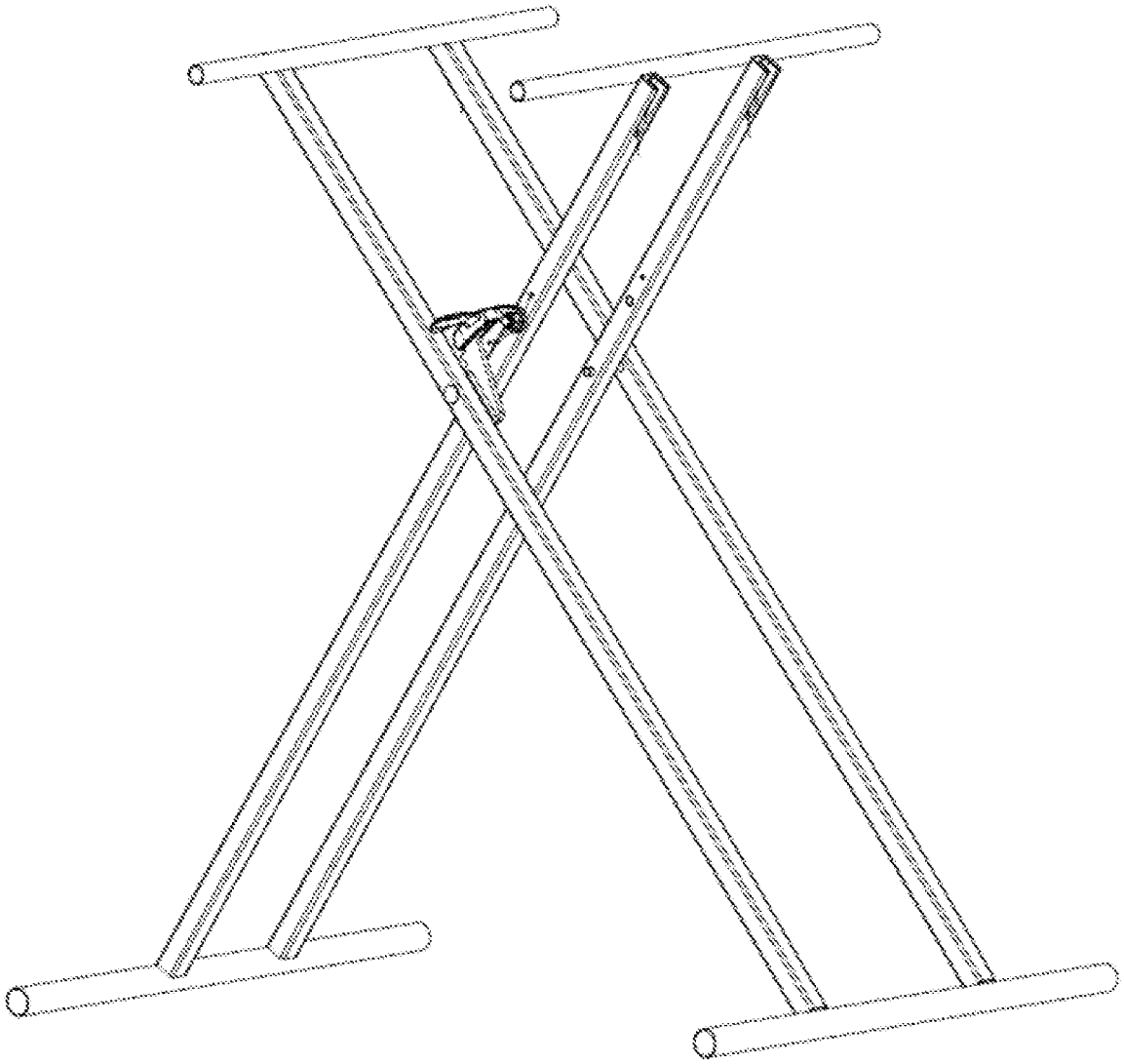
FIG. 11 is a perspective view illustrating the exemplary leg assembly of FIG. 10 at a second height in accordance with exemplary embodiments of the present disclosure.
Figure 12:
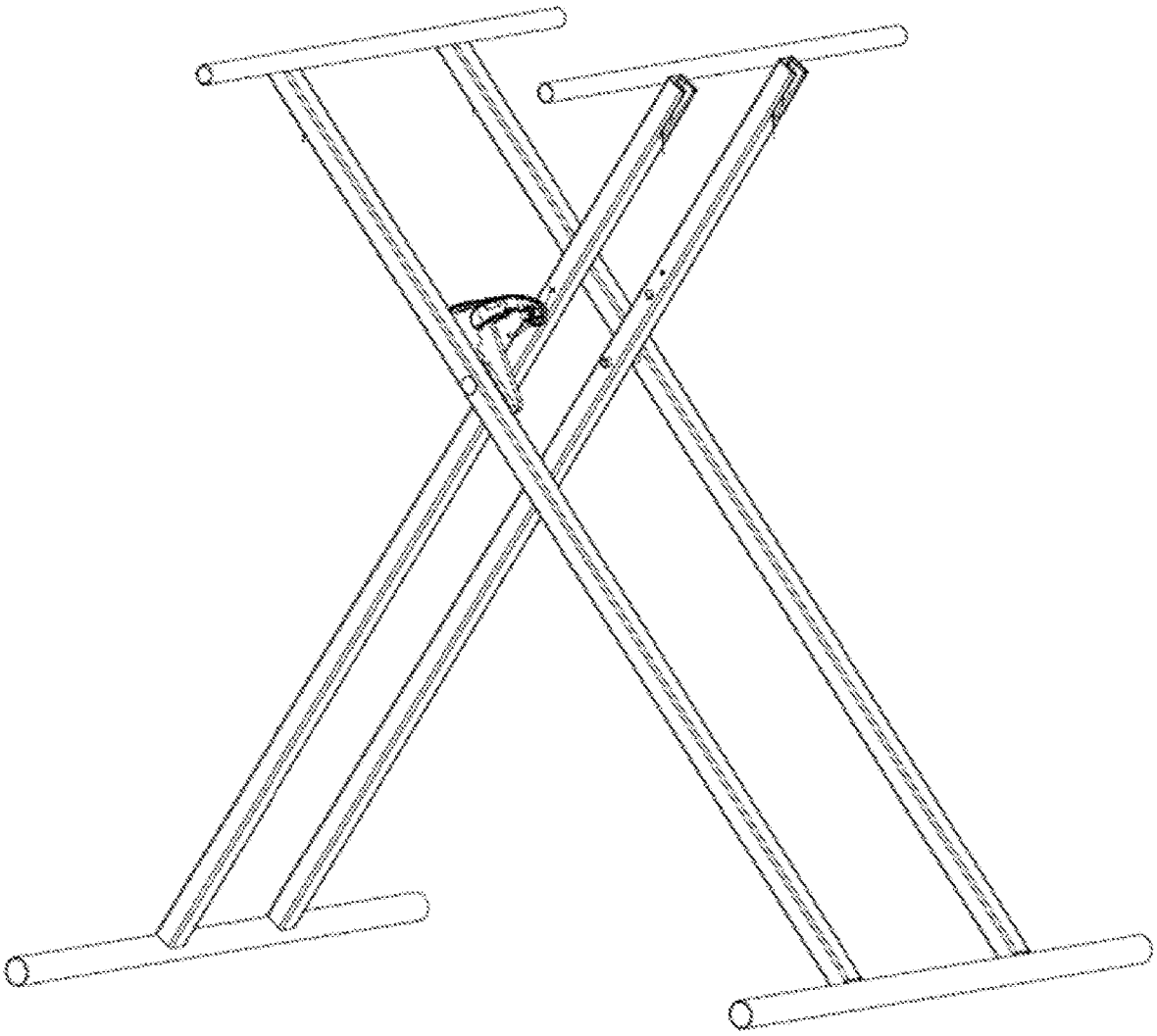
FIG. 12 is a perspective view illustrating the exemplary leg assembly of FIG. 10 at a third height in accordance with exemplary embodiments of the present disclosure.
Figure 13A:
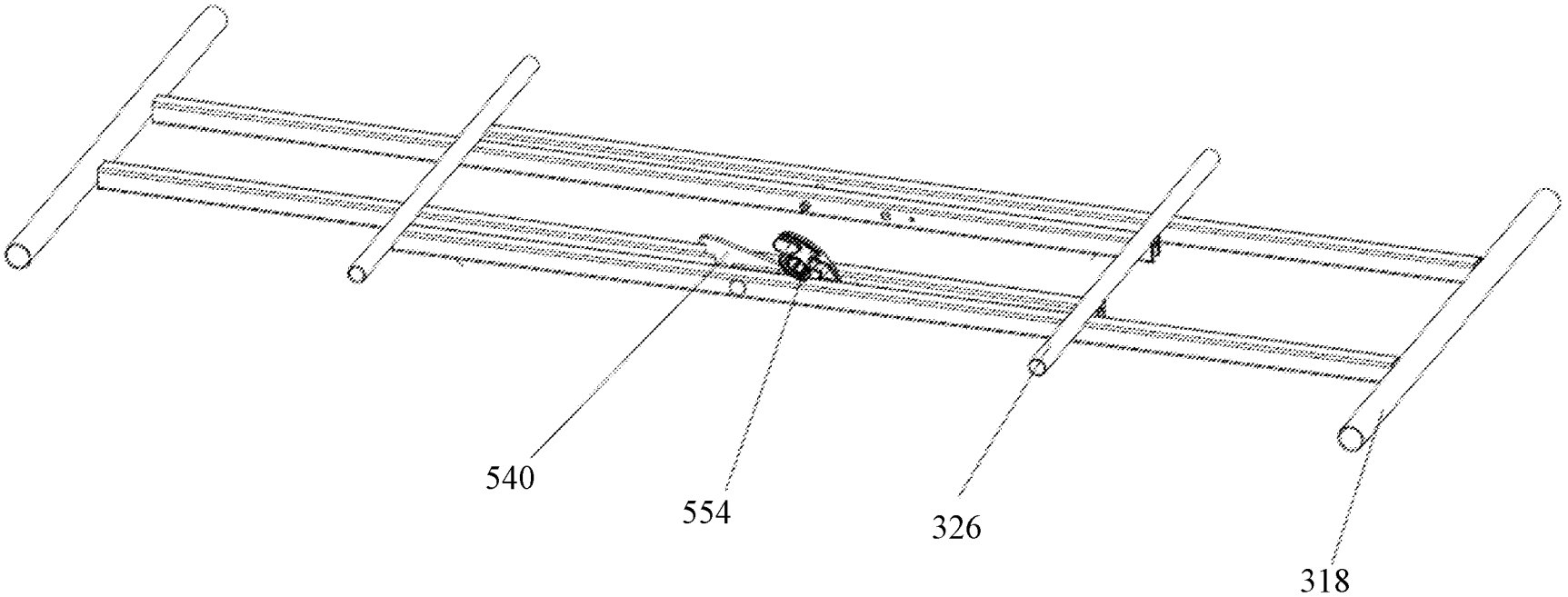
FIG. 13A is a perspective view illustrating the exemplary leg assembly of FIG. 10 in a folded state in accordance with exemplary embodiments of the present disclosure.
Figure 13B:
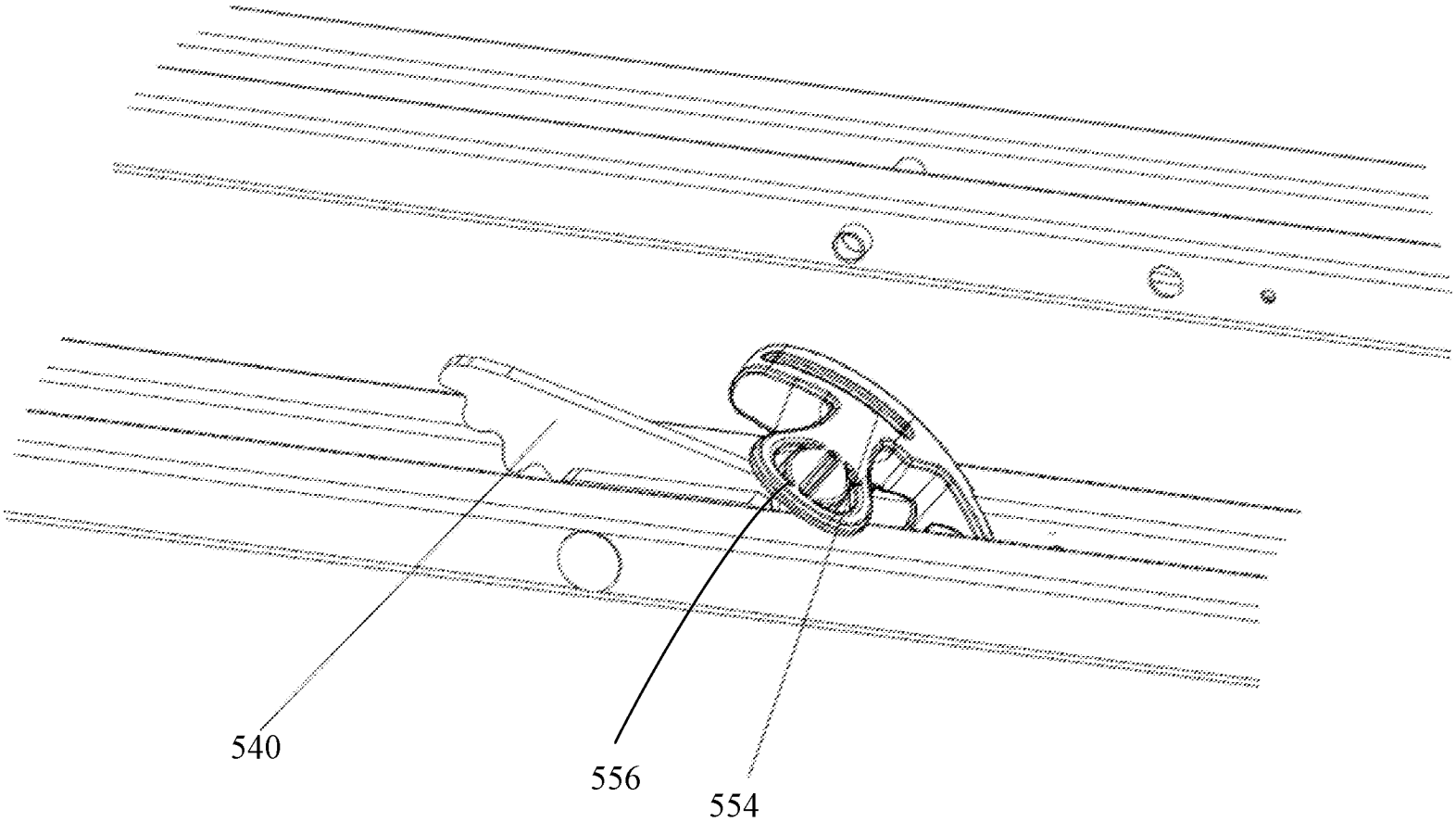
FIG. 13B is a partially enlarged view of the exemplary leg assembly of FIG. 10
Figure 14A:
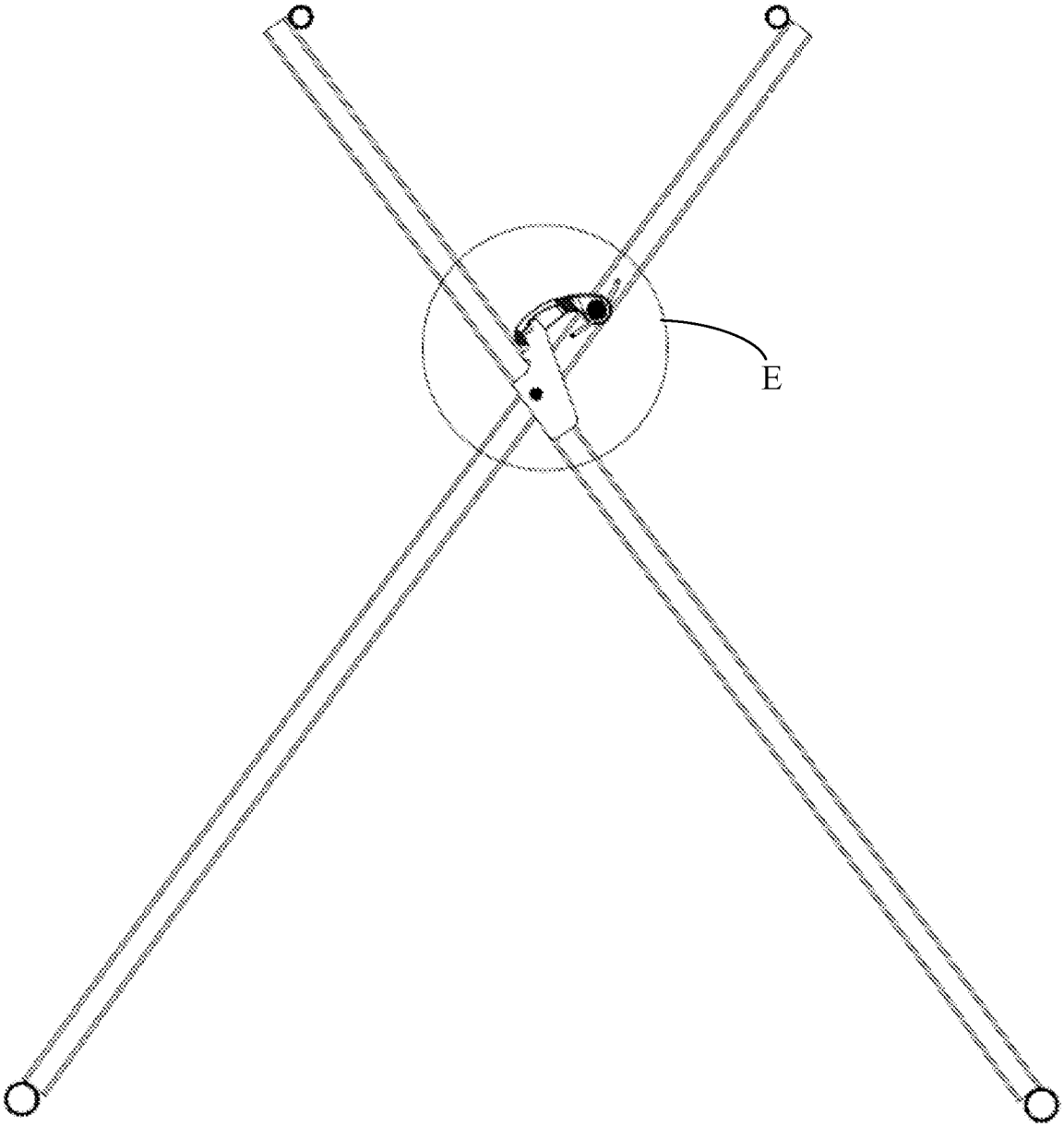
FIG. 14A is a partially cutout side view illustrating the exemplary leg assembly of FIG. 10 in accordance with exemplary embodiments of the present disclosure.
Figure 14B:
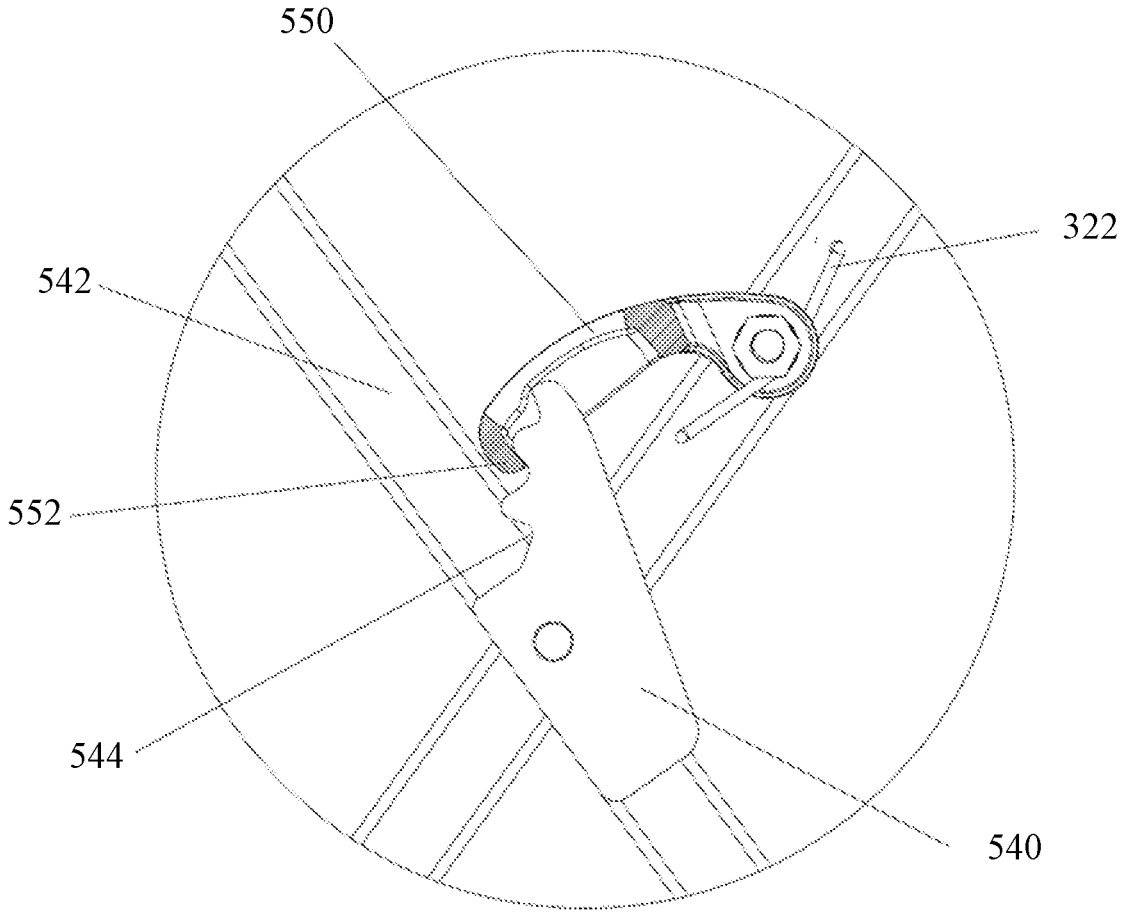
FIG. 14B is an enlarged view taken along circle E of FIG. 14A.

Engagement of the second coupling piece with a positioning slot in the first coupling piece sets the first bar of the first support and the second bar of the second support at a specific angle "a". Engagement of the first coupling piece with different positioning slots changes the angle "a" between the first bar of the first support and the second bar of the second support, resulting in the leg assembly (and thus the table) at different heights, as illustrated in FIGS. 10, 11 and 12. In an exemplary embodiment, the three different heights are about 700 mm, about 650 mm, and about 600 mm, respectively. Releasing of the second coupling piece from the first coupling piece allows the first bar of the first support and the second bar of the second support to rotate with respect to each other, and to be disposed substantially in a common plane as illustrated in FIG. 13A.

In some exemplary embodiments, the second coupling piece is perforated, e.g., including an opening, such as opening 554. The opening is formed adjacent to the end portion of the second coupling piece. As such, when the end portion of the second coupling piece is engaged with a positioning slot in the plurality of positioning slots (e.g., the lowest slot in FIG. 14B), the opening allows a portion of the first coupling piece to pass through to ensure that the end portion of the second piece can be properly engaged with the selected positioning slot.

In some exemplary embodiments, the second coupling piece includes a lug, such as lug 556, formed at a side of the second coupling piece. The lug allows easy operation of the mechanism. For instance, to adjust the height of the table, one can pull the lug (e.g., lift the lug upward) to disengage the end portion of the second coupling piece from the current slot, place the end portion of the second piece into a desired slot, and then release the lug to allow the end portion of the second coupling piece to engage with the desired slot.

Similar to mechanism 330, in some exemplary embodiments, mechanism 530 also includes a torsion spring, such as torsion spring 360, to prevent accidental disengagement of the first and second coupling pieces. The torsion spring is disposed between the second coupling piece and the second bar of the second support at a pivotal point to which the second coupling piece is connected to the second bar of the second support. The torsion spring is connected to the second coupling piece and the second bar of the second support, and exerts a torque on the second coupling piece to prevent accidental separation or disengagement of the end portion of the second coupling piece from the selected positioning slot formed in the first coupling piece. The torsion spring helps to stabilize the table when in use.

With the mechanisms disclosed herein, the leg assemblies and tables of the present invention are simple, easy-to-use, foldable and height-adjustable.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A table comprising:

a tabletop; and a leg assembly to support the tabletop, the leg assembly comprising:

a first support movably connected to the tabletop at a first portion of the tabletop, the first support comprising a first bar;

a second support movably connected to the tabletop at a second portion of the tabletop, the second support comprising a second bar, wherein the first bar of the first support and the second bar of the second support are pivotally connected to each other at middle portions thereof; and a mechanism for adjusting a height of the leg assembly, the mechanism comprising a first coupling piece disposed at the first bar of the first support and a second coupling piece pivotally connected to the second bar of the second support, wherein one of the first and second coupling pieces comprises a plurality of positioning slots, and the other of the first and second coupling pieces is selectively engageable with any one of the plurality of positioning slots, thereby allowing changing a first angle between the first bar of the first support and the second bar of the second support to change the height of the leg assembly.

2. The table of claim 1, wherein the first coupling piece is fixedly connected to or integrally formed with the first bar of the first support.

3. The table of claim 1, wherein:

the first bar of the first support and the second bar of the second support are connected to each other at a first pivotal point;

the first coupling piece of the mechanism is disposed at the first bar of the first support adjacent to or above the first pivotal point; and the second coupling piece of the mechanism is pivotally connected to the second bar of the second support above the first pivotal point.

4. The table of claim 1, wherein:

the first support comprises a pair of first bars, a first upper crossbar and a first lower crossbar, wherein the first bars are spaced apart from each other in a first direction of the table, and each first bar has an upper end portion connected to the first upper crossbar and a lower end portion connected to the first lower crossbar; and the second support comprises a pair of second bars, a second upper crossbar and a second lower crossbar, wherein the second bars are spaced apart from each other in the first direction of the table, and each second bar has an upper end portion connected to the second upper crossbar and a lower end portion connected to the second lower crossbar.

5. The table of claim 4, wherein the tabletop comprises first, second, third and fourth engagement slots, wherein:

the first and second engagement slots are disposed in the first portion of the tabletop, and spaced apart in the first direction of the table with openings of the first and second engagement slots facing each other; and the third and fourth engagement slots are disposed in the second portion of the tabletop, and spaced apart in the first direction of the table with openings of the third and fourth engagement slots facing each other;

the first upper crossbar of the first support has a first end received in the first engagement slot and a second end received in the second engagement slot such that the first upper crossbar is slidable along the first and second engagement slots in a second direction of the table; and the second upper crossbar of the second support has a first end received in the third engagement slot and a second end received in the fourth engagement slot such that the second upper crossbar is slidable along the third and fourth engagement slots in the second direction of the table.

6. The table of claim 1, wherein:

the second coupling piece is connected to the second bar of the second support at a second pivotal point; and the mechanism further comprises a torsion spring disposed at the second pivotal point between the second coupling piece and the second bar of the second support, wherein the torsion spring is connected to the second coupling piece and the second bar of the second support, and configured to prevent accidental disengagement of the first and second coupling pieces.

7. The table of claim 1, wherein the leg assembly further comprises a third bar to help support the tabletop, wherein the third bar is pivotally connected to the tabletop and pivotally connected to the first bar of the first support or the second bar of the second support.

8. The table of claim 1, wherein:

the second coupling piece comprises a channel generally elongated in a length direction of the second coupling piece and a plurality of positioning slots formed at a side of the channel; and the first coupling piece is received, cross-sectional-wise, in the channel of the second coupling piece such that the first coupling piece is movable along the channel and selectively engageable with a respective positioning slot in the plurality of positioning slots, thereby allowing the leg assembly to be positioned at a corresponding height in a plurality of heights.

9. The table of claim 8, wherein the first coupling piece is a pin or a post.

10. The table of claim 8, wherein the channel of the second coupling piece comprises a first portion and a second portion at a second angle with respect to the first portion.

11. The table of claim 10, wherein two or more positioning slots in the plurality of positioning slots are formed along the first portion of the channel.

12. The table of claim 10, wherein a positioning slot in the plurality of positioning slots is formed at an end of the second portion of the channel, wherein when the first coupling piece engages with the positioning slot formed at the end of the second portion of the channel, the first angle is substantially 180 degrees.

13. The table of claim 1, wherein:

the plurality of positioning slots is formed on an edge of the first coupling piece; and the second coupling piece comprises an end portion releasably engageable with any one of the plurality of positioning slots.

14. The table of claim 13, wherein the end portion of the second coupling piece is a hook, a clamp, or a hook toggle clamp.

15. The table of claim 13, wherein when engaging with a respective positioning slot in the plurality of positioning slots, the end portion of the second coupling piece abuts a corresponding tooth formed on the edge of the first coupling piece adjacent to the respective positioning slot.

16. The table of claim 13, wherein the second coupling piece comprises an opening adjacent to the end portion of the second coupling piece to allow a portion of the first coupling piece to pass through when the end portion of the second coupling piece is engaged with a positioning slot in the plurality of positioning slots.

17. A table comprising:

a tabletop comprising first, second, third and fourth engagement slots, wherein the first and second engagement slots are disposed in a first portion of the tabletop and spaced apart in a first direction of the table with openings of the first and second engagement slots facing each other; and the third and fourth engagement slots are disposed in a second portion of the tabletop and spaced apart in the first direction of the table with openings of the third and fourth engagement slots facing each other; and a leg assembly to support the tabletop, the leg assembly comprising:

a first support comprising a first upper crossbar having a first end received in the first engagement slot and a second end received in the second engagement slot such that the first upper crossbar is slidable along the first and second engagement slots in a second direction of the table;

a second support comprising a second upper crossbar having a first end received in the third engagement slot and a second end received in the fourth engagement slot such that the second upper crossbar is slidable along the third and fourth engagement slots in the second direction of the table; and a mechanism for adjusting a height of the leg assembly, the mechanism comprising a first coupling piece fixedly connected to or integrally formed with the first support and a second coupling piece pivotally connected to the second support, wherein:

the second coupling piece comprises a channel generally elongated in a length direction of the second coupling piece and a plurality of positioning slots formed at a side of the channel; and the first coupling piece is received, cross-sectional-wise, in the channel of the second coupling piece such that the first coupling piece is movable along the channel and selectively engageable with a respective positioning slot in the plurality of positioning slots, thereby allowing the leg assembly to be positioned at a corresponding height in a plurality of heights.

18. The table of claim 17, wherein the channel of the second coupling piece comprises a first portion and a second portion at an obtuse angle with respect to the first portion, wherein two or more positioning slots in the plurality of positioning slots are formed along the first portion of the channel, and at least one positioning slot in the plurality of positioning slots is formed at an end of the second portion of the channel.

19. A table comprising:

a tabletop comprising first, second, third and fourth engagement slots, wherein the first and second engagement slots are disposed in a first portion of the tabletop and spaced apart in a first direction of the table with openings of the first and second engagement slots facing each other; and the third and fourth engagement slots are disposed in a second portion of the tabletop and spaced apart in the first direction of the table with openings of the third and fourth engagement slots facing each other; and a leg assembly to support the tabletop, the leg assembly comprising:

a first support comprising a first upper crossbar having a first end received in the first engagement slot and a second end received in the second engagement slot such that the first upper crossbar is slidable along the first and second engagement slots in a second direction of the table;

a second support comprising a second upper crossbar having a first end received in the third engagement slot and a second end received in the fourth engagement slot such that the second upper crossbar is slidable along the third and fourth engagement slots in the second direction of the table; and a mechanism for adjusting a height of the leg assembly, the mechanism comprising a first coupling piece fixedly connected to or integrally formed with the first support and a second coupling piece pivotally connected to the second support, wherein:

the first coupling piece comprises a plurality of positioning slots formed on an edge thereof; and the second coupling piece comprises an end portion releasably and selectively engageable with a respective positioning slot in the plurality of positioning slots, thereby allowing the leg assembly to be positioned at a corresponding height in a plurality of heights.

20. The table of claim 19, wherein the end portion of the second coupling piece is a hook, a clamp, or a hook toggle clamp, and the second coupling piece comprises an opening adjacent to the end portion of the second coupling piece to allow a portion of the first coupling piece to pass through when the end portion of the second coupling piece is engaged with a positioning slot in the plurality of positioning slots.

* * * * *